US007257338B2

(12) United States Patent
Yoshida

(10) Patent No.: US 7,257,338 B2
(45) Date of Patent: Aug. 14, 2007

(54) IMAGE FORMING APPARATUS

(75) Inventor: Yukimasa Yoshida, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 111 days.

(21) Appl. No.: 11/032,108

(22) Filed: Jan. 11, 2005

(65) Prior Publication Data

US 2005/0158064 A1 Jul. 21, 2005

(30) Foreign Application Priority Data

Jan. 20, 2004 (JP) ..... 2004-012125

(51) Int. Cl.
*G03G 15/00* (2006.01)

(52) U.S. Cl. ..... 399/49; 399/55

(58) Field of Classification Search ..... None
See application file for complete search history.

(56) References Cited

U.S. PATENT DOCUMENTS 4,536,082 A 8/1985 Motohashi et al.
4,922,293 A * 5/1990 Bando ..... 399/38
2003/0091356 A1* 5/2003 Komatsu et al. ..... 399/49

FOREIGN PATENT DOCUMENTS

| | | |
|---|---|---|
| JP | A 58-208770 | 12/1983 |
| JP | A 61-255363 | 11/1986 |
| JP | A 62-127778 | 6/1987 |
| JP | A 8-262818 | 10/1996 |
| JP | A 7-140769 | 6/1999 |

* cited by examiner

*Primary Examiner*—Vincent Q. Nguyen
(74) *Attorney, Agent, or Firm*—Oliff & Berridge, PLC

(57) ABSTRACT

An image forming apparatus that forms an image having proper density regardless of changes in a charged amount of developer per unit mass is provided. When image data is received in a laser printer, a main motor is driven to rotate a photosensitive drum, etc., and charging bias is applied to a charger to charge the photosensitive drum. Then, paper is fed. Predetermined current detection developing bias is applied to a developing roller for a predetermined period of time. A current value of a developing current during the application is detected. Developing bias applied to the developing roller is calculated so as to keep constant density in the printed image. Particularly, a charged amount of toner per unit mass (Q/M) is calculated from the detected current value. Based on the Q/M, the developing bias is calculated. A print process is performed by applying the developing bias to the developing roller.

18 Claims, 19 Drawing Sheets

IMAGE FORMING APPARATUS

BACKGROUND OF THE INVENTION i) Technical Field of the Invention

This invention relates to an image forming apparatus that forms an image on a recording material using developer.

ii) Description of the Related Art

Conventionally, in an image forming apparatus that forms an image on a recording material using developer, image density is often varied depending on conditions like the use environment and the number of prints. Therefore, there are cases in which desired density can not be obtained.

Unexamined Patent Publication No. 7-140769 discloses an image forming device in which a reference pattern consisting of a toner image for density detection is formed on a photosensitive drum. Based on the detected density of the reference pattern, the optimum developing bias at the time of actual developing is obtained.

SUMMARY OF THE INVENTION

Density variation of an image formed using developer is largely affected by a change in charged amount per unit mass of the developer.

However, in a configuration of the aforementioned disclosure, if the charged amount per unit mass of the developer is largely changed, the relationship between the reference pattern and the developing bias is also largely changed. Accordingly, an image having appropriate density is no longer obtainable.

It is one object of the present invention to provide an image forming apparatus that allows formation of an image with adequate density even if the charged amount per unit mass of the developer is changed.

In order to attain the above object, an image forming apparatus of the first aspect of the present invention comprises a rotary driven photoreceptor, a charging device that charges a surface of the photoreceptor, an exposing device that exposes the photoreceptor charged by the charging device to form an electrostatic latent image, and a developing device that develops, using developer, the electrostatic latent image formed on the photoreceptor by the exposing device, to form a developer image. The image forming apparatus forms the developer image on the photoreceptor by means of the charging device, the exposing device, and the developing device, and transfers the developer image onto a recording material to form an image on the recording material.

The image forming apparatus further comprises a charged amount detection device that detects a charged amount per unit mass of the developer used by the developing device. The image forming apparatus further comprises a developing bias adjustment device. The developing bias adjustment device adjusts developing bias to regulate a ratio of the charged amount per unit mass detected by the charged amount detection device to an electric current which flows between the developing device and the photoreceptor at the time of developing the electrostatic latent image representing a reference image.

The "developing bias" herein means a difference between an electric potential of the developing device (such as a developing roller) and a latent image potential in the photoreceptor (such as a photosensitive drum). The latent image potential in the photoreceptor is an electric potential of a part in the photoreceptor, exposed by the exposing device after being charged by the charging device. The followings are some of the examples on how to "adjust the developing bias":

(1) adjust the electric potential of the developing device;

(2) adjust the latent image potential in the photoreceptor by adjusting the exposure level by the exposing device (e.g., emission intensity of a light source, such as a laser emitting diode and an LED, used for exposure); and (3) adjust a charged potential in the photoreceptor by adjusting the charging level of the charging device (e.g., voltage applied to the charging device such as a scorotron charger). The charge potential in the photoreceptor is the electric potential of a part in the photoreceptor charged by the charging device. The latent image potential in the photoreceptor is affected by the charged potential. For example, even if the conditions are the same for exposure by the exposing device, the latent image potential increases along with an increase of the charged potential. Accordingly, effective adjustment of the latent image potential in the photoreceptor becomes possible.

According to the image forming apparatus of the present invention, even if the charged amount per unit mass of the developer used by the developing device is changed, an image with the proper density can be formed.

In other words, if the developing bias is set to be a fixed value, density of the image formed using the developer is changed as the charged amount per unit mass of the developer is changed. Therefore, the image forming apparatus of the present invention detects the charged amount per unit mass of the developer and, based on the detected charged amount, adjusts the developing bias.

Particularly, a developer amount per unit time (i.e., the density of the image when considering a fixed image) moving from the developing device to the photoreceptor when the electrostatic latent image is developed by the developing device is almost proportional to the electric current flowing from the developer to the photoreceptor (that is, a moving amount of electric charge per unit time) divided by the charged amount per unit mass of the developer. Therefore, as in the present image forming apparatus, by regulating the ratio of the charged amount per unit mass of the developer to the electric current flowing between the developing device and the photoreceptor when the electrostatic latent image representing the reference image is developed, the amount of the developer used to form the reference image (and further the density of the developer image) is regulated. Consequently, according to the image forming apparatus of the present invention, the developing bias can be adjusted so that the image can be formed with proper density, regardless of the change in charged amount per unit mass of the developer.

The reference image is a given image determined to be an appropriate reference. The reference image can be a blacked-out image, for example, or any other image. It is not necessary, in the present image forming apparatus, to actually measure the electric current which flows between the developing device and the photoreceptor when the electrostatic latent image representing the reference image is developed. The image forming apparatus may store, in advance, data (such as numerical expressions and tables) from which the developing bias for regulating the ratio of the charged amount to the electric current can be obtained regardless of the change in the charged amount per unit mass of the developer.

It is preferable that the charged amount detection device of the present image forming apparatus detects the charged amount per unit mass of the developer used by the developing device, based on a current value of the electric current flowing between the part of the photoreceptor charged by the charging device but not exposed by the exposing device, and the developing device.

There is a correlation between the current value of the electric current flowing between the part of the photoreceptor charged by the charging device but not exposed by the exposing device and the charged amount per unit mass of the developer. Therefore, the charged amount per unit mass of the developer can be detected in an indirect manner as stated above.

Since there is no necessity of a device (such as an electric potential sensor) which detects the charged amount per unit mass of the developer in a direct manner, the present image forming apparatus can be configured at a low cost. Moreover, since there is no necessity of forming a developer image exclusively for density detection, for the purpose of adjusting the developing bias, wasteful use of the developer can be avoided. Also, adjustment of the developing bias can be performed in a relatively short time.

As the second aspect of the present invention, the charged amount detection device of the above-described image forming apparatus may detect the charged amount per unit mass of the developer used by the developing device, based on the current value of the electric current flowing between the part of the photoreceptor charged by the charging device but not exposed by the exposing device, and the developing device. In addition, the developing bias adjustment device may adjust the developing bias based on the charged amount per unit mass detected by the charged amount detection device.

In configurations as above, it is desirable that the current value of the electric current is detected as indicated below.

That is, the charging device starts charging a surface of the photoreceptor at a timing earlier than the passing timing of a head portion of an image forming area, where the electrostatic latent image is formed by the exposing device, at a time of image forming. Or, the charging device may terminate charging the surface of the photoreceptor at a timing slower than the passing timing of a tail portion of the image forming area at the time of the image forming. The charged amount detection device detects the current value of the electric current flowing between the part or the photoreceptor charged by the charging device but where no electrostatic latent image is formed by the exposing device and the developer unit, during the image forming. In this manner, there is no need to spare extra time for adjusting the developing bias. An increase of waiting time during the image forming can be avoided. Specifically, the present image forming apparatus allows adjustment of the developing bias per each piece of recording material, when image forming is performed for a plurality of recording materials. It is desirable that the developing bias is readjusted before image forming after a long-term period of nonuse.

The image forming apparatus may further comprise an initializing device that performs initialization at a predetermined timing as a preparation for starting the image forming. The charged amount detection device may detect the current value of the electric current flowing between the part of the photoreceptor charged by the charging device but not exposed by the exposing device, and the developer unit, during the initialization by the initializing device. Again, there is no need to spare extra time for adjusting the developing bias. An increase of waiting time during the image forming can be inhibited.

The charged amount detection device may detect the current value of the electric current while the photoreceptor makes at least one revolution. Or, the charged amount detection device may detect the current value of the electric current at a plurality of different rotating positions of the photoreceptor. In either case, fluctuation or false detection by eccentricity of the photoreceptor or by a change in the characteristics of the photoreceptor in a circumferential direction can be avoided. Reliability of the detected value is improved.

The charged amount per unit mass of the developer can be also detected (calculated) as follows.

That is, the charged amount detection device of the image forming apparatus in the first aspect of the present invention may comprise a specific pattern forming unit that forms a developer image representing a specific pattern, an adhered developer amount detecting unit that detects the developer amount adhered to the developer image formed by the specific pattern forming unit, and a gross charged amount detection unit that detects the gross charged amount of the developer image formed by the specific pattern forming unit. In this case, the charged amount detecting unit detects the charged amount per unit mass of the developer, based on the gross charged amount of the developer image detected by the gross charged amount detecting unit, and the adhered developer amount detected by the adhered developer amount detecting unit.

The adhered developer amount detecting unit can be designed, for example, to detect the density of the developer image formed by the specific pattern forming unit as the developer amount adhered to the developer image.

Also, the gross charged amount detecting unit can be designed, for example, to comprise a neutralizing unit that neutralizes latent image charge in the developer image formed by the specific pattern forming unit, and a surface potential detecting unit that detects the surface potential of the developer image after the latent image charge is neutralized by the neutralizing unit, as the gross charged amount of the developer image.

The developer may be a polymerized toner. A change in the charged amount per unit mass of the polymerized toner is usually larger than a change in the charged amount per unit mass of a ground toner. Effects on the image density are large if the change in the charged amount is large. Therefore, in a configuration in which the polymerized toner is used as the developer, significantly large effects are generated by adjustment of the developer bias.

BRIEF DESCRIPTION OF THE DRAWING

The invention will now be described, by way of example, with reference to the accompanying drawings, in which.

DETAILED DESCRIPTION OF PREFERRED EMBODIMENT

Figure 1:
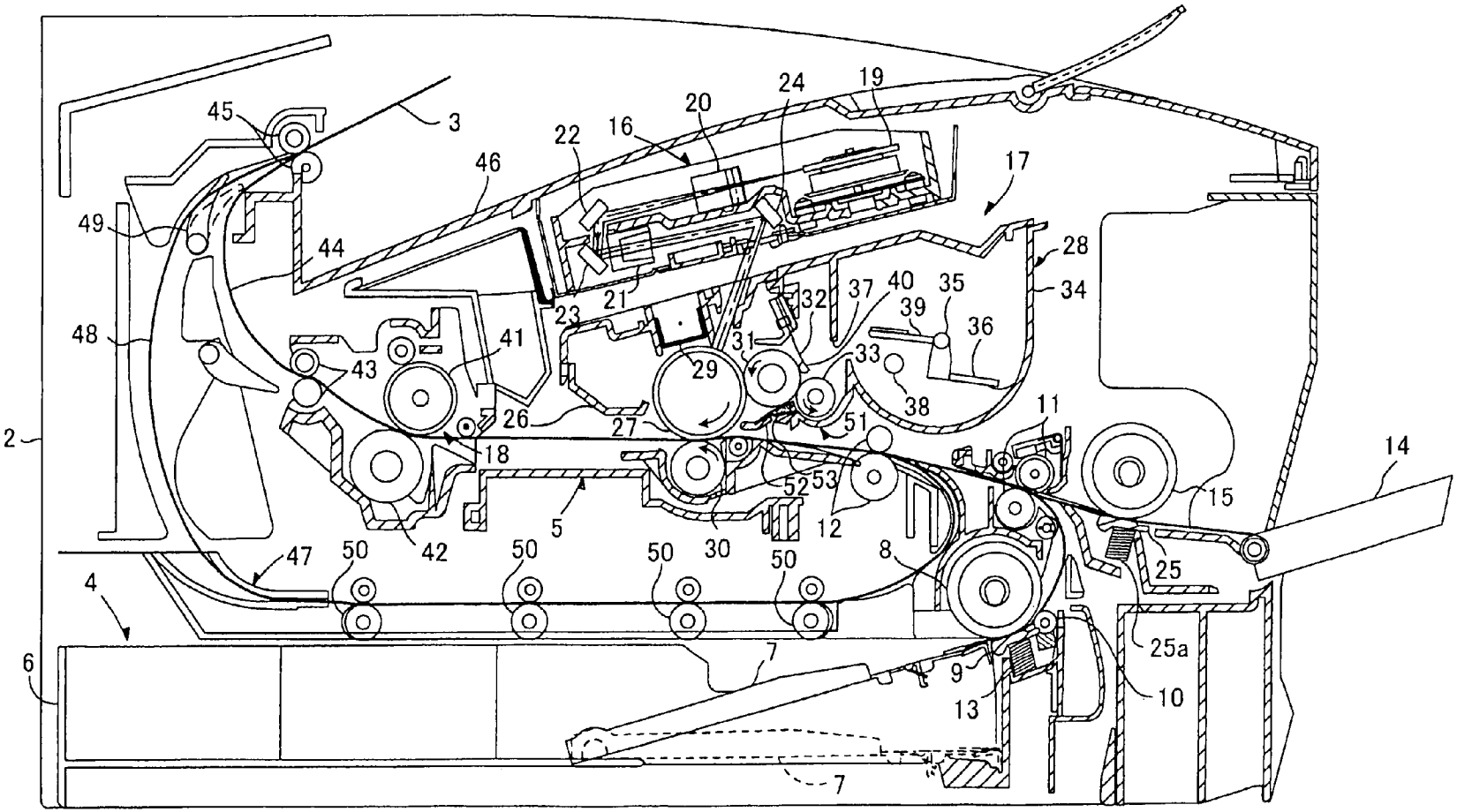
FIG. 1 is a sectional side view of a laser printer according to an embodiment.

Referring to FIG. 1, a laser printer 1 of the present embodiment comprises a body casing 2, inside of which a feeder portion 4 and an image forming portion 5 are provided. The feeder portion 4 feeds paper P (not shown), and the image forming portion 5 forms a predetermined image on the fed paper P.

The feeder portion 4 includes a feed tray 6 detachably attached to a bottom section inside of the body casing 2, a paper pressing plate 7 provided inside of the feed tray 6, a feed roller 8 and a feed pad 9 provided above an end on one side of the feed tray 6, paper powder removing rollers 10 and 11 provided downstream of the feed roller 8 in the conveying direction of the paper P, and a pair of resist rollers 12 provided downstream of the paper powder removing rollers 10 and 11 in the conveying direction of the paper P.

Furthermore, a feed sensor 60 not shown in FIG. 1 (see FIG. 2), that turns ON when it detects the passing of the paper P, is provided at a position close to a substantially central part of the resist rollers 12.

The paper P can be stacked on the paper pressing plate 7. The paper pressing plate 7 is swingably supported at one end farther from the feed roller 8 so that the other end closer to the feed roller 8 can be shifted in up and down directions. The paper pressing plate 7 is also urged upward from a substantially horizontal position by a not shown spring. Therefore, as the stacked volume of the paper P increases, the paper pressing plate 7 is shifted downward, against the urging force of the spring, with the one end farther from the feed roller 8 acting as a fulcrum. The feed roller 8 and the feed pad 9 are arranged opposed to each other. The feed pad 9 is pressed against the feed roller 8 by a spring 13 provided on a backside of the feed pad 9. The top-most paper P on the paper pressing plate 7 is pressed against the feed roller 8 by the not shown spring located at the backside of the paper pressing plate 7. After being clipped between the feed roller 8 and the feed pad 9 as a result of rotation of the feed roller 8, the paper P is fed one by one. Paper powder is removed by the paper powder removing rollers 10 and 11, and the fed paper P is conveyed to the resist rollers 12. After a prescribed resist period by the resist rollers 12, the paper P is conveyed to the image forming portion 5.

The feeder portion 4 further includes a multipurpose tray 14, a multi-purpose feed roller 15 and a multipurpose feed pad 25. The multipurpose feed roller 15 and the multipurpose feed pad 25 feed the paper P stacked on the multipurpose tray 14. The multipurpose feed roller 15 and the multipurpose feed pad 25 are arranged opposed to each other. The multipurpose feed pad 25 is pressed against the multipurpose feed roller 15 by a spring 25*a* provided on the backside of the multipurpose feed pad 25. The paper P stacked on the multipurpose tray 14 is fed one by one, after being clipped between the multipurpose feed roller 15 and the multipurpose feed pad 25 as a result of the rotation of the multipurpose feed roller 15.

The image forming portion 5 includes a scanner unit 16, a process unit 17 and a fixing unit 18.

The scanner unit 16 is arranged in an upper section inside of the body casing 2. The scanner unit 16 includes a laser emitting portion (not shown), a rotationally driven polygon mirror 19, lenses 20 and 21, and reflecting mirrors 22, 23 and 24. A laser beam generated based on predetermined image data and emitted from the laser emitting portion is passed through, or reflected on, the polygon mirror 19, the lens 20, the reflecting mirrors 22 and 23, the lens 21, and the reflecting mirror 24, in this order, as shown in dotted lines, and then irradiated on a surface of a later-explained photosensitive drum 27 of the process unit 17 by high speed scanning.

The process unit 17 is arranged below the scanner unit 16. The process unit 17 includes the photosensitive drum 27, a developer cartridge 28, a scorotron charger 29, and a transfer roller 30, all located inside a drum cartridge 26 detachably attached to the body casing 2.

The developer cartridge 28 is detachably attached to the drum cartridge 26. The developer cartridge 28 includes a developer roller 31, a layer thickness control blade 32, a supply roller 33, and a toner receptor 34.

Inside the toner receptor 34, toner of a positively charged nonmagnetic single component is filled as a developer. The toner is, for example, a polymerized toner that can be obtained by copolymerization in a well-known manner like suspension copolymerization of a polymeric monomer such as a styrene polymer like styrene or an acrylic monomer like acrylic acid, alkyl (C1 to C4) acrylate, and alkyl (C1 to C4) methacrylate. Such polymerized toner has a spherical shape and is superior in fluidity. The polymerized toner is capable of forming high-quality images. Colorant like carbon black or wax is dispensed in such a toner. An additive like silica is added to improve fluidity. The toner is about 6 to 10 μm in particle diameter.

The toner inside the toner receptor 34 is agitated in a clockwise direction as a result of rotation of an agitator 36, which is supported by a rotation shaft 35 provided in the middle of the toner receptor 34. The toner is then discharged from a toner supply opening 37 which is opened at a side part of the toner receptor 34. On a side wall of the toner receptor 34, a window 38 is provided for checking a remaining amount of the toner. The window 38 is cleaned by a cleaner 39 also supported by the rotation shaft 35.

Beside the toner supply opening 37, the supply roller 33 is arranged so as to rotate in the direction of the arrow shown in FIG. 1 (i.e., a counterclockwise direction). Opposite to the supply roller 33, the developer roller 31 is arranged so as to rotate in a direction of the arrow (i.e., counterclockwise direction). The supply roller 33 and the developer roller 31 are abutted on each other in such a manner that each compresses the other to some extent.

The supply roller 33 is composed of a metal roller shaft coated with a conductive sponge body.

The developer roller 31 is composed of a metal roller shaft coated with an elastic body, that is, a conductive rubber material. More particularly, the developer roller 31 is a roller body made of conductive urethane rubber or silicone rubber including carbon particles, on the surface of which is coated with a layer of urethane rubber or silicone rubber including fluorine. A predetermined developing bias against the photosensitive drum 27 is applied to the developer roller 31.

The layer thickness control blade 32 is arranged near the developer roller 31, The layer thickness control blade 32 is composed of a blade body made of metal plate spring material, at a tip of which is provided a pressing portion 40 having a semicircular cross section made of insulating silicone rubber. The layer thickness control blade 32 is supported by the case 51 of the developer cartridge 28, near the developer roller 31. The pressing portion 40 is pressed against the developing roller 31 by the elastic force of the blade body.

The toner discharged from the toner supply opening 37 is supplied to the developer roller 31 as a result of the rotation of the supply roller 33. At this time, the toner is positively charged by friction between the supply roller 33 and the developer roller 31. The toner supplied to the developer roller 31 is further advanced, along with the rotation of the developer roller 31, between the pressing portion 40 of the layer thickness control blade 32 and the developer roller 31, where the toner is further charged by sufficient friction. The toner is then carried onto the developer roller 31 as a thin layer having a relatively constant thickness.

The photosensitive drum 27 is arranged so as to rotate in the direction of the arrow (i.e., a clockwise direction), in a manner facing the developer roller 31, beside the developer roller 31. The drum body of the photosensitive drum 27 is grounded. A surface part of the photosensitive drum 27 is formed from a positively charged photosensitive layer including polycarbonate.

The scorotron charger 29 is arranged above the photosensitive drum 27, spaced apart by a predetermined interval therefrom, so as not to be brought into contact therewith. The scorotron charger 29 is for positive charging and generates a corona discharge from a charging wire such as tungsten. The scorotron charger 29 positively charges a surface of the photosensitive drum 27 in a uniform manner at a predetermined electrical potential by a later-explained charging bias controller 62 (FIG. 2).

After positively charging the surface of the photosensitive drum 27 using the scorotron charger 29 by rotation of the photosensitive drum 27, high speed laser scanning is performed by the scanner unit 16 to expose the surface of the photosensitive drum 27 to form an electrostatic latent image thereon based on the predetermined image data.

Figure 2:
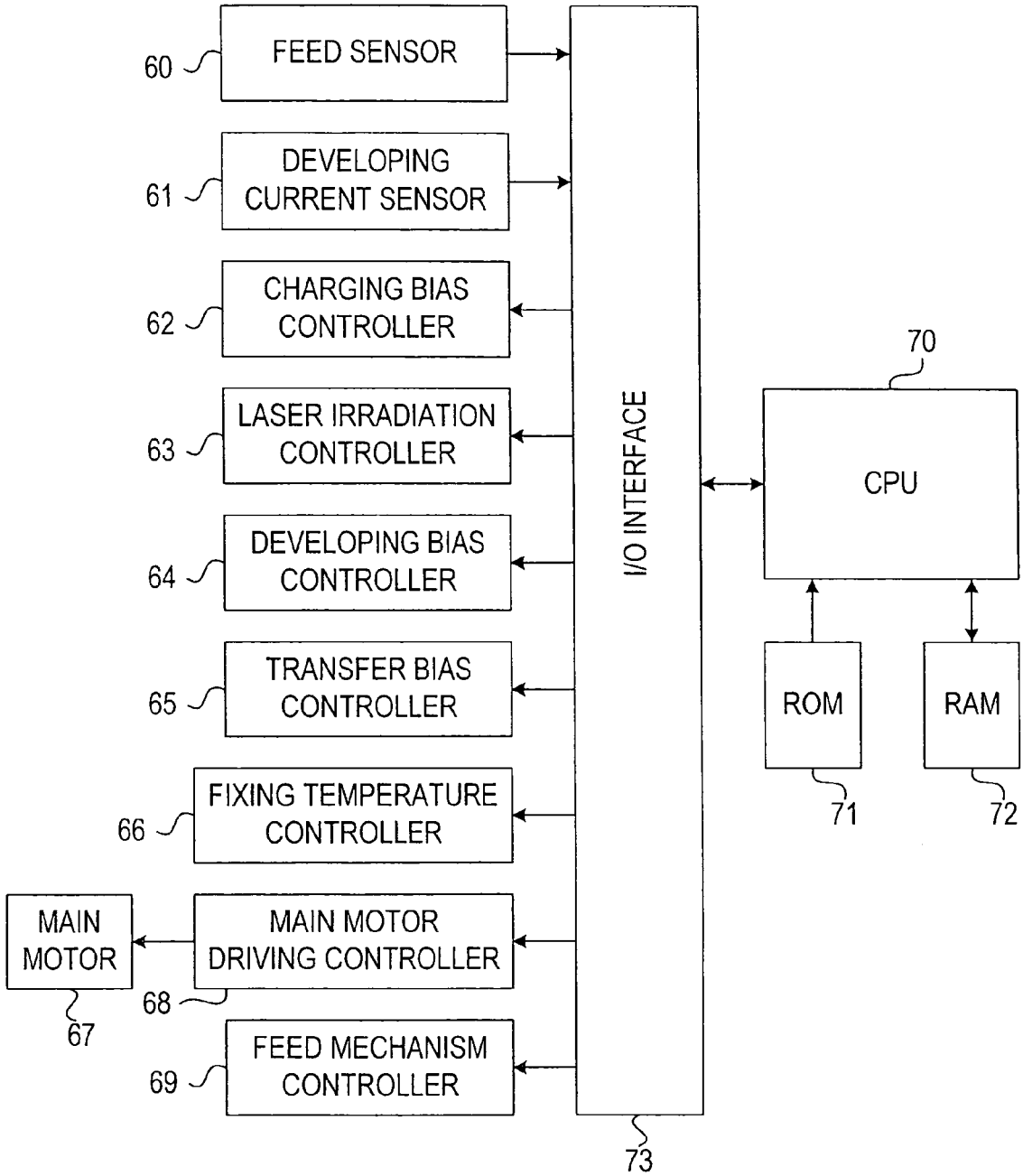
FIG. 2 is a block diagram showing an electrical configuration of the laser printer according to the embodiment.

The scanner unit 16 is controlled by a later-explained laser emission controller 63 (FIG. 2).

The positively charged toner carried onto the developer roller 31 is brought into contact against the photosensitive drum 27 by the rotation of the developer roller 31.

Predetermined developing bias is applied to the developer roller 31 by a later-explained developing bias controller 64 (FIG. 2). The "developing bias" herein means a difference between the electric potential of the developer roller 31 and a latent image potential in the photosensitive drum 27 (i.e., the electric potential of a part exposed by the scanner unit 16 after being charged by the scorotron charger 29).

The toner brought into contact against the photosensitive drum 27 is supplied to the electrostatic latent image formed on the surface of the photosensitive drum 27, that is, the exposed part of the surface of the photosensitive drum 27 positively charged in a uniform manner, where an electric potential is lowered by having been exposed to the laser beam. The toner selectively carried onto the photosensitive drum 27 becomes a visual image, and thus reverse developing is achieved.

The transfer roller 30 is arranged below the photosensitive drum 27 in a manner opposed to the photosensitive drum 27. The transfer roller 30 is supported by the drum cartridge 26 and is rotatable in the direction of the arrow (i.e., counterclockwise direction). The transfer roller 30 is composed of a metal roller shaft coated with a conductive rubber material. The transfer roller 30 is controlled by a later-explained transfer bias controller 65 (FIG. 2). At the time of the transfer, predetermined transfer bias is applied to the photosensitive drum 27. Accordingly, the visual image carried onto the surface of the photosensitive drum 27 is transferred on the paper P while the paper P is passed between the photosensitive drum 27 and the transfer roller 30.

As shown in FIG. 1, the fixing unit 18 is arranged next to and downstream of the process unit 17. The fixing unit 18 includes a heating roller 41, a pressing roller 42 that presses against the heating roller 41, and a pair of conveying rollers 43 provided downstream of the heating roller 41 and the pressing roller 42. The heating roller 41 is provided with a metallic halogen lamp for heating. The toner transferred on the paper P in the process unit 17 is heat fixed by the heating roller 41 while the paper P is passed between the heating roller 41 and the pressing roller 42. The paper P is then conveyed to a discharge path 44 by the conveying rollers 43. Temperature of the heating roller 41 is controlled by a later-explained fixing temperature controller 66 (FIG. 2).

The paper P conveyed to the discharge path 44 is further passed to a pair of discharge rollers 45 to be discharged onto a discharge tray 46.

The laser printer 1 further comprises a reverse conveying portion 47 in order to form an image on both sides of the paper P. The reverse conveying portion 47 includes the discharge rollers 45, a reverse conveying path 48, a flapper 49, and a plurality of pairs of reverse conveying rollers 50.

Operation of the discharge rollers 45 is designed to be switched between forward rotation and reverse rotation. As described above, the discharge rollers 45 rotate forward when discharging the paper P onto the discharge tray 46. The discharge rollers 45 rotate reverse when reversing the paper P.

The reverse conveying path 48 is provided along a vertical direction of the laser printer 1, so that the paper P can be conveyed from the discharge rollers 45 to the plurality of pairs of reverse conveying rollers 50 arranged below the image forming portion 5. An end part at an upstream side of the reverse conveying path 48 is arranged near the discharge rollers 45. An end part at a downstream side of the reverse conveying path 48 is arranged near the reverse conveying rollers 50.

The flapper 49 is swingably arranged to face a turning point between the discharge path 44 and the reverse conveying path 48. The flapper 49 is designed to switch the conveying direction of the paper P reversed by the discharge rollers 45 from a direction toward the discharge path 44 to a direction toward the reverse conveying path 48, by way of excitation or nonexcitation of a not shown solenoid.

The plurality of pairs of reverse conveying rollers 50 are arranged in a substantially horizontal direction above the feed tray 6. A pair of reverse conveying rollers 50 located at the most upstream side are arranged near a rear end of the reverse conveying path 48. A pair of reverse conveying rollers located at the most downstream side are arranged approximately below the resist rollers 12.

When an image is formed on both sides of the paper P, the reverse conveying portion 47 is operated as follows. When the paper P, on one side of which an image is formed, is conveyed by the conveying rollers 43 from the discharge path 44 to the discharge rollers 45, the discharge rollers 45 are rotated forward, clipping (holding) the paper P therebetween to convey the paper P towards the outside (to the side of the discharge tray 46). When a substantial part of the paper is conveyed to the outside with a rear edge of the paper P still being clipped between the discharge rollers 45, the discharge rollers 45 terminate their forward rotation and then rotate in a reverse direction. The flapper 49 switches the conveying direction so that the paper P is conveyed to the reverse conveying path 48 in a reversely directed state. The flapper 49, when conveyance of the paper P is completed, is returned to its original state, that is, a state for passing the paper P, conveyed from the conveying rollers 43, to the discharge rollers 45. The paper P, conveyed from the reverse conveying path 48 in the reversely directed state, is then conveyed to the reverse conveying rollers 50 where the paper P is turned over and sent to the resist rollers 12. The paper P sent to the resist rollers 12 is again conveyed toward the image forming portion 5 after the prescribed resist period in a reversed state, so that the predetermined image is formed on both sides of the paper P.

Also, the laser printer 1 adopts a so-called cleanerless system, in which the remainder of the toner left on the surface of the photosensitive drum 27, is collected by the developer roller 31 after an image is transferred onto the paper P by the transfer roller 30. If the toner left on the surface of the photosensitive drum 27 is collected in this manner, there is no necessity of providing a cleaning tool like a blade or providing storage for wasted toner. Simplification and miniaturization of the apparatus and reduction of costs can be achieved.

Now, print operation performed in the laser printer 1 is described.

Firstly, the paper P is fed from the feeder portion 4 or the multipurpose tray 14 and conveyed to the image forming portion 5. In the process unit 17 constituting the image forming portion 5, the surface of the photosensitive drum 27 is uniformly charged by the scorotron charger 29 while the photosensitive drum 27 is being rotationally driven. High speed laser scanning is then performed by the scanner unit 16 to expose the surface of the photosensitive drum 27. The toner from the developing roller 31 is adhered to an electrostatic latent image formed on the surface of the photosensitive drum 27 in this manner. As a result, a toner image is formed on the photosensitive drum 27. The toner image is transferred by the transfer roller 30 to which the transfer bias is applied, to the paper P conveyed between the photosensitive drum 27 and the transfer roller 30. The paper P, to which the toner image is transferred, is then conveyed to the fixing unit 18 where the paper P is heated by the heating roller 41 at a predetermined temperature and pressed by the pressing roller 42 so that the toner image is fixed on the paper P.

Next, an electric configuration of the laser printer 1 is described by way of a block diagram in FIG. 2.

As shown in FIG. 2, the laser printer 1 comprises the aforementioned feed sensor 60, a developing current sensor 61 that detects the current value of an electric current (i.e., developing current) passing between the photosensitive drum 27 and the developing roller 31, a charging bias controller 62 that controls the charging bias applied to the scorotron charger 29, a laser irradiation controller 63 that controls the laser beam emitted from the scanner unit 16, a developing bias controller 64 that controls developing bias applied to the developing roller 31, a transfer bias controller 65 that controls transfer bias applied to the transfer roller 30, a fixing temperature controller 66 that controls the temperature of the heating roller 41 provided in the fixing unit 18, a main motor drive controller 68 that controls the main motor 67 which rotationally drives various members in the laser printer 1 (such as the photosensitive drum 27 and the heating roller 41), a feed mechanism controller 69 that controls the feed mechanism of the feed roller 8, a known CPU 70, a ROM 71, a RAM 72 and an I/O interface 73.

The laser printer 1 of the present embodiment detects by the developing current sensor 61, the current value of the developing current flowing between a part of the photosensitive drum 27 uniformly charged by the scorotron charger 29 but not exposed by a laser beam from the scanner unit 16, and the developing roller 31. From the detected value, a charged amount per unit mass (hereafter, referred to as Q/M) of the toner is determined. Based on the Q/M, the developing bias is adjusted so that the image is printed with the appropriate density.

In the following, the reason why the developing bias is adjusted in such a manner is explained.

Figure 3:
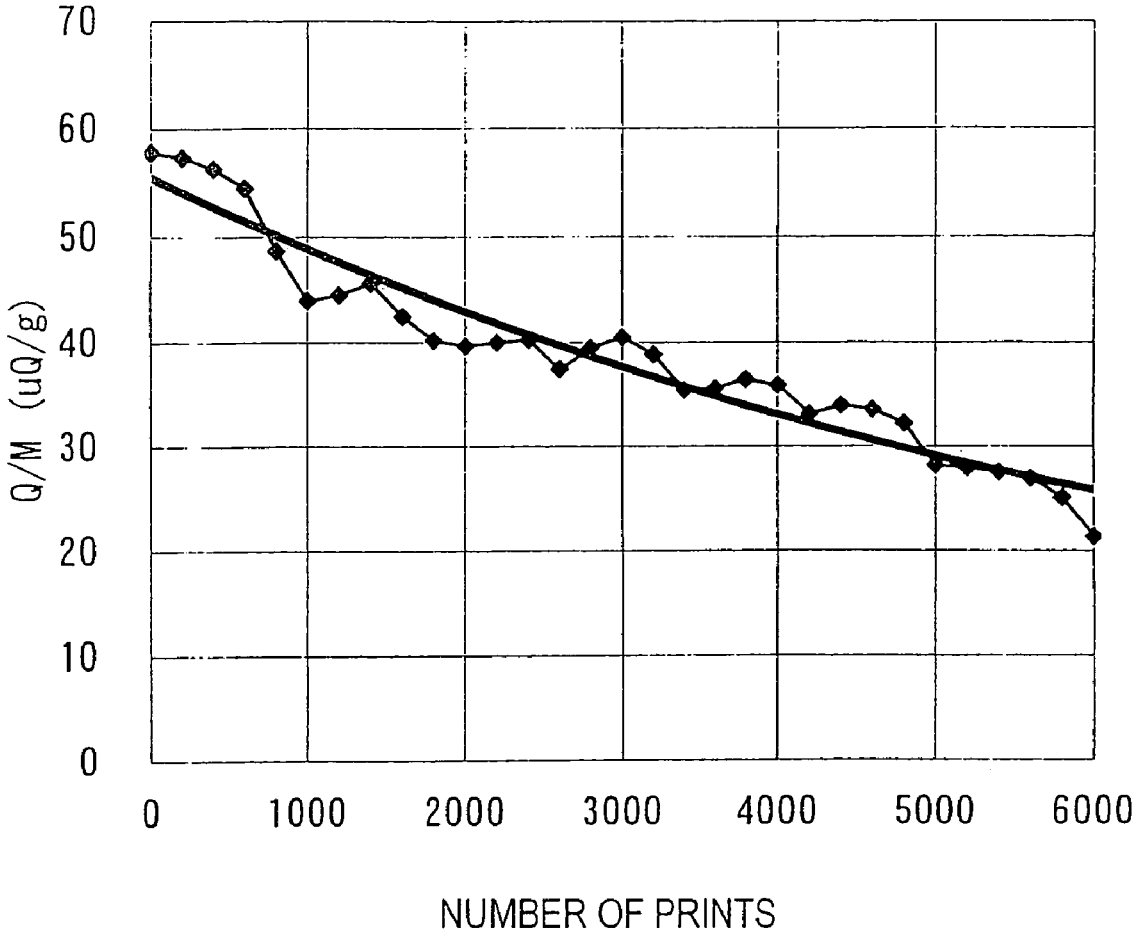
FIG. 3 is a graph showing a relationship between the number of prints and a charged amount per unit mass (Q/M) of toner.

FIG. 3 is a graph showing changes in Q/M of toner with respect to the number of prints, in an experiment in which the printing of a predetermined image is repeated while the developing bias is set as a fixed value. A laser printer having the same configuration as the laser printer 1 and a toner having the same components as the toner of the laser printer 1, are used in the experiment. It is clear from the graph that as the number of prints increases (that is, as the use period of the toner is lengthened and the quality of the toner is deteriorated), the Q/M of the toner is lowered.

Figure 4:
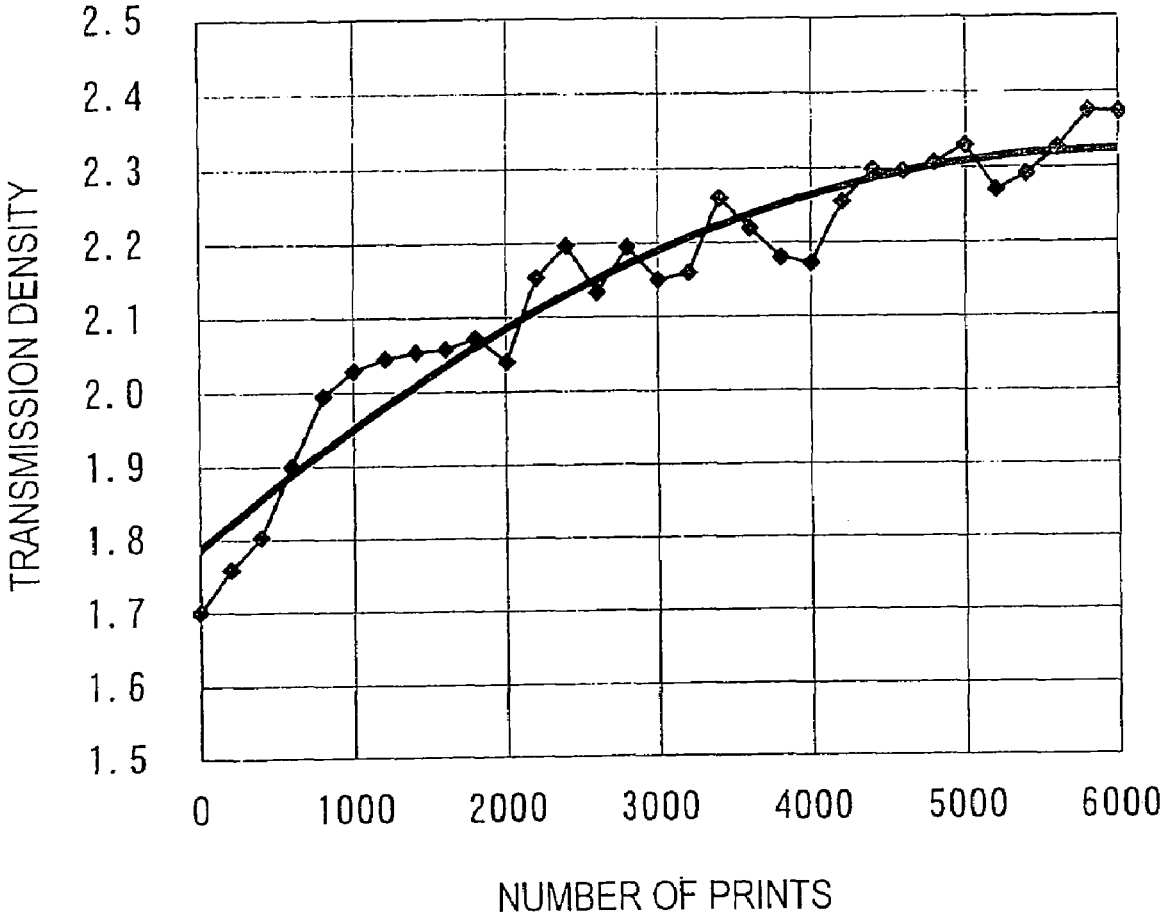
FIG. 4 is a graph showing a relationship between the number of prints and transmission density of a toner image.

FIG. 4 is a graph showing changes in transmission density of a toner image with respect to the number of prints in the above experiment. It is understood from the graph that as the number of prints increases, the transmission density of the toner (and consequently, the density of a printed image) becomes high. The transmission density herein is expressed by a common logarithm (log(1/T)) of a reciprocal of transmissivity (T) obtained when a visible light is irradiated at the toner image.

In other words, as the Q/M of the toner decreases, the density of the image formed by the toner becomes high.

As above, even if the developing bias is set as a fixed value, the density of the printed image is not always constant. Therefore, as the toner is deteriorated due to use of the apparatus, the density of the printed image becomes gradually higher.

Therefore, it is necessary to regulate the image density regardless of the changes in the Q/M of the toner.

The density of the printed image is proportional to an adhered amount of the toner per unit area. The adhered amount of the toner is determined by electric current flowing from the developing roller to the photosensitive drum at a time of developing, and the Q/M of the toner at the time. The electric current flowing from the developing roller to the photosensitive drum at the time of developing is represented as an amount of electric charge moved from the developing roller to the photosensitive drum per unit time as a result of a move of the toner. Therefore, by dividing the electric current (i.e., the moving amount of electric charge) by the Q/M of the toner, the moving amount of the toner (i.e., the adhered amount of toner) can be determined.

Figure 5:
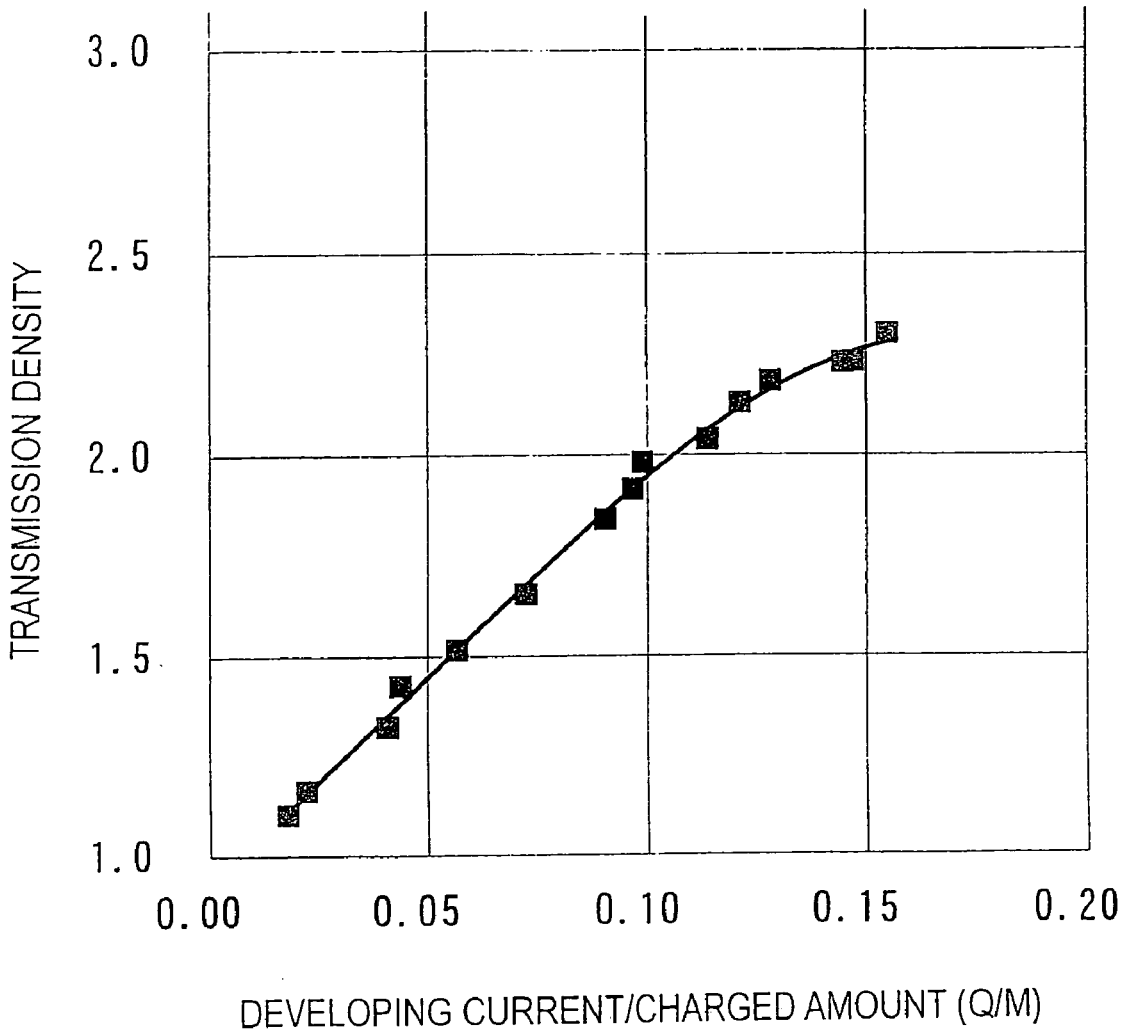
FIG. 5 is a graph showing a relationship between a current value of a developing current divided by the Q/M and the transmission density of the toner.

FIG. 5 is a graph showing a relationship between a value of developing current flowing from the developing roller to the photosensitive drum, when the electrostatic latent image representing a reference image (i.e., a blackout image in this experiment) is developed, divided by the Q/M of the toner at the time (i.e., the amount of the toner conveyed from the developing roller to the photosensitive drum), and the transmission density of the toner image formed by the developing (i.e., the adhered amount of the toner per unit area). Referring to this graph, it is noted that degree of rise in the transmission density is lowered when the values of the developing current/charged amount (Q/M) are large. Assumably, this is because supply of the toner by the developing roller was delayed (possibly because of performance limitations of the developing roller). Therefore, attention should be paid to the linear portion of the graph before the degree of rise in the transmission density becomes smaller. Relationship between the transmission density D, the developing current I, and the Q/M at the time of developing can be expressed as an equation (1) below.

$$D=a(I/(Q/M))+b \quad (1)$$

where a and b: constants

As above, it is confirmed that the value obtained by dividing the developing current I at the time of developing by the Q/M and the transmission density D are correlated (particularly, almost proportional) to each other. Accordingly, if the developing current I at the time of developing and the Q/M are determined, the image density D can also be determined. That is, if the value of the developing current I divided by the Q/M is adjusted so as to be regulated, the image density D can also be regulated.

Now, in order to set the developing current I at the time of developing to a desired electric current value, adjustment of the developing bias is considered. However, by applying a certain developing bias, the current value of the developing current flowing at the time of developing varies depending on the deterioration level of the toner, even if the image developed is the same. This means that the developing current is changed along with the toner deterioration even if the same developing bias is applied.

Figure 6:
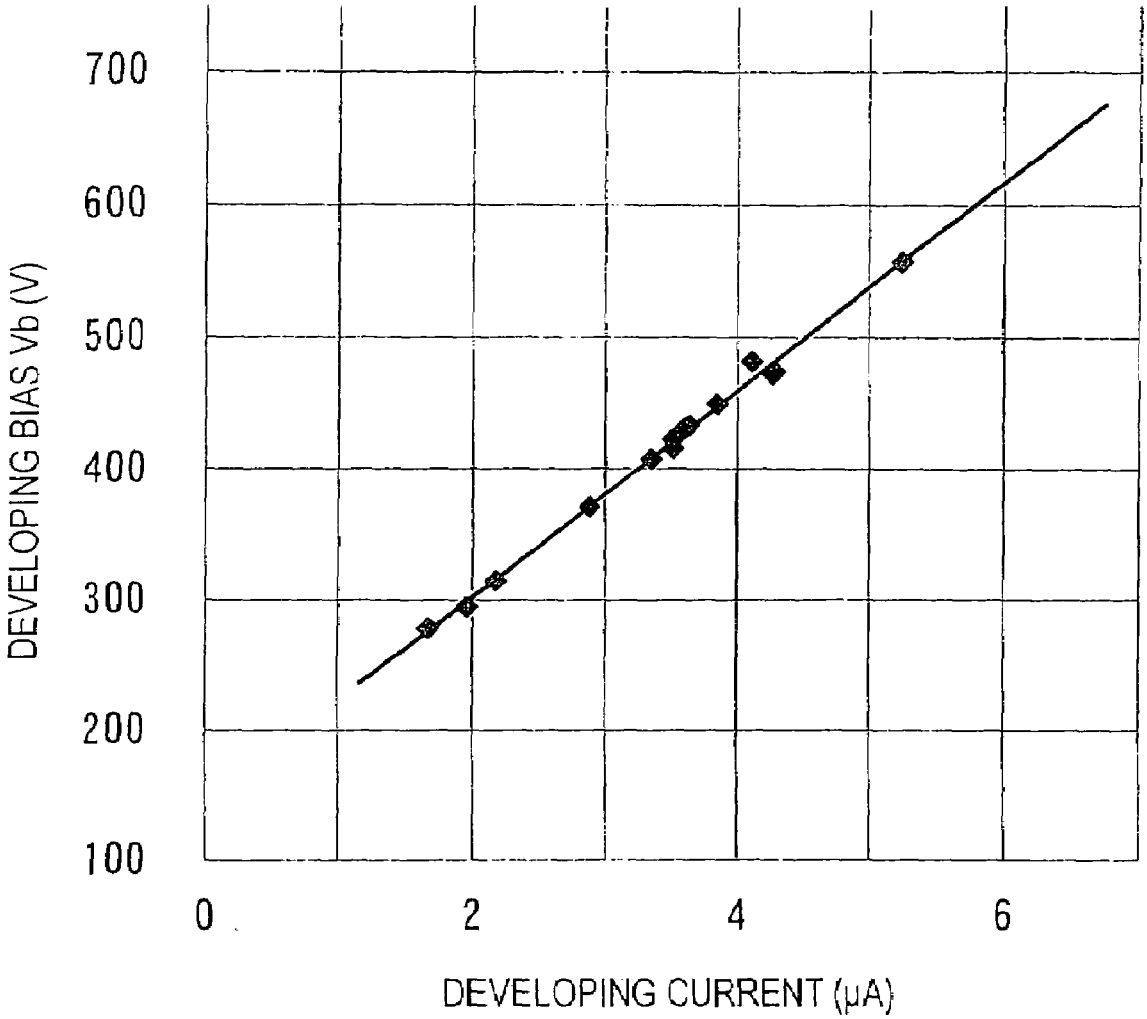
FIG. 6 is a graph showing a relationship between the developing current and developing bias when the moving amount of the toner is fixed.

Under the conditions that the moving amount of the toner is constant however, as shown in FIG. 6, the relationship between the developing current and the developing bias is constant. Particularly, the relationship between the developing bias Vb and the developing current I at the time of developing can be expressed as an equation (2) below.

$$Vb=cI+d \quad (2)$$

where c and d: constants

That is, when printing a reference image, under conditions that the density of the reference image is constant (i.e., the moving amount of the toner is constant), the relationship between the developing bias Vb and the developing current I at the time of developing is constant. Accordingly, using an expression (i.e., equation (2)) showing the relationship between a developing current and a developing bias concerning target density, the developing bias to be applied in order to set the developing current to a desired value can be obtained.

Figure 7:
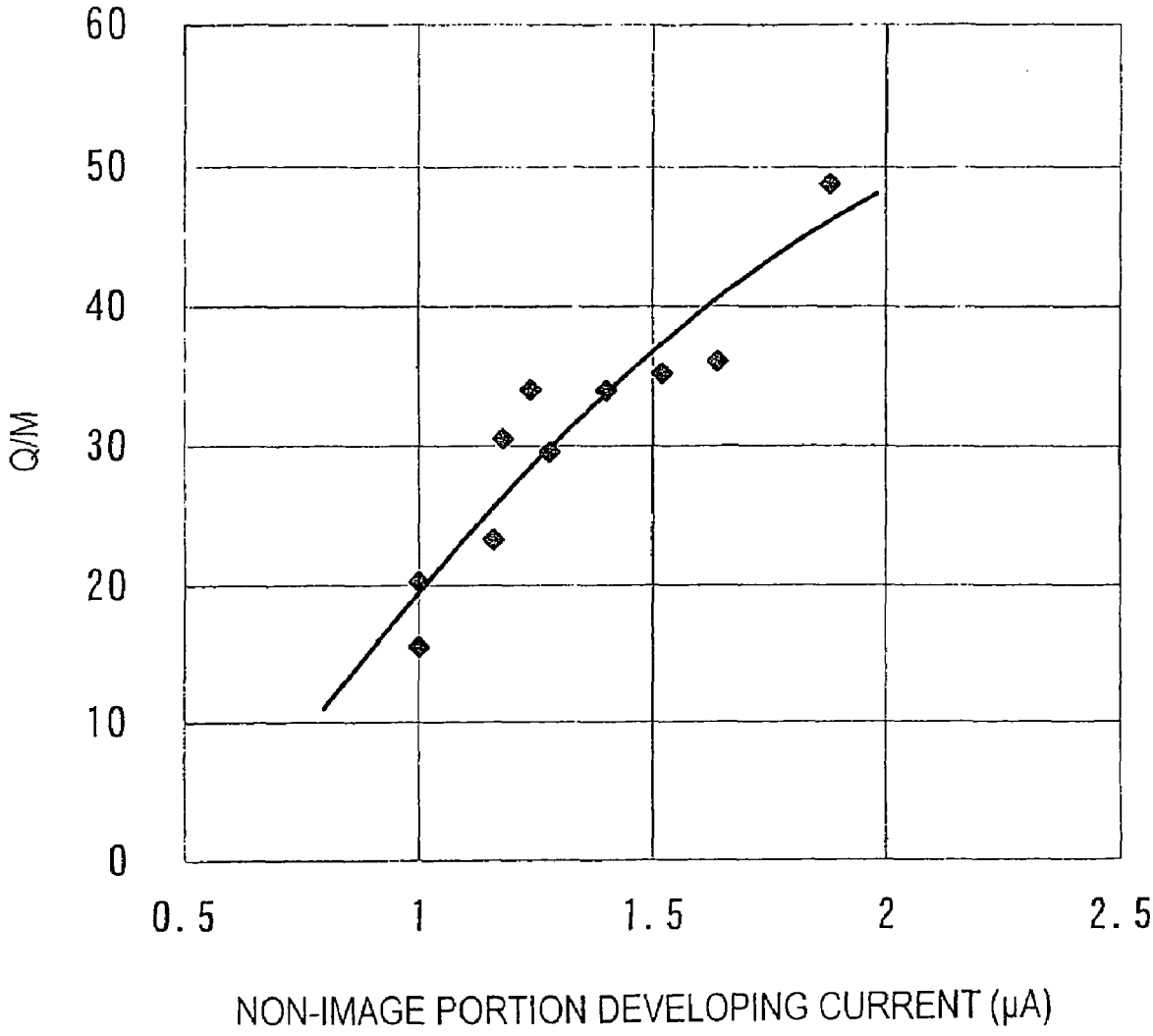
FIG. 7 is a graph showing a relationship between a non-image portion developing current and the Q/M when the developing bias is a fixed value.

Even in a state that the photosensitive drum is charged by the scorotron charger and not exposed by the scanner unit, the developing current (hereafter, the developing current is referred to as "non-image portion developing current") is generated if an electric potential of the developing roller differs from an electric potential of the photosensitive drum. By exploring the relationship between the non-image portion developing current and the Q/M of the toner when the developing bias is fixed to a constant value Vb0 (in this example, the electric potential of the developing roller is 300V, but can be set to any other value lower than the charged potential (i.e., 700V, in this example) in the photosensitive drum), it is found that there is a tendency as shown in FIG. 7. The relationship between the non-image portion developing current Iw and the Q/M is expressed as an equation (3) below.

$$Q/M=eIw^2+fIw+g \quad (3)$$

where e, f, and g: constants

As above shown, in a state in which the photosensitive drum is charged by the scorotron charger and not exposed by the scanner unit, the developing current Iw depends on the value of the Q/M of the toner.

Accordingly, if the developing current is measured in a state in which the photosensitive drum is not exposed, it is possible to obtain the Q/M of the toner based on the measured developing current. Using the Q/M, the developing bias for printing an image having the proper density can be determined.

The state "not exposed" herein does not mean a state in which the whole photosensitive drum is not exposed, but means a state in which at least a part of the photosensitive drum is exposed which is brought into contact with the developing roller.

In the laser printer 1 of the present embodiment, the aforementioned equations (1) to (3) are stored in the ROM 71 and processes using these equations are executed.

Figure 8:
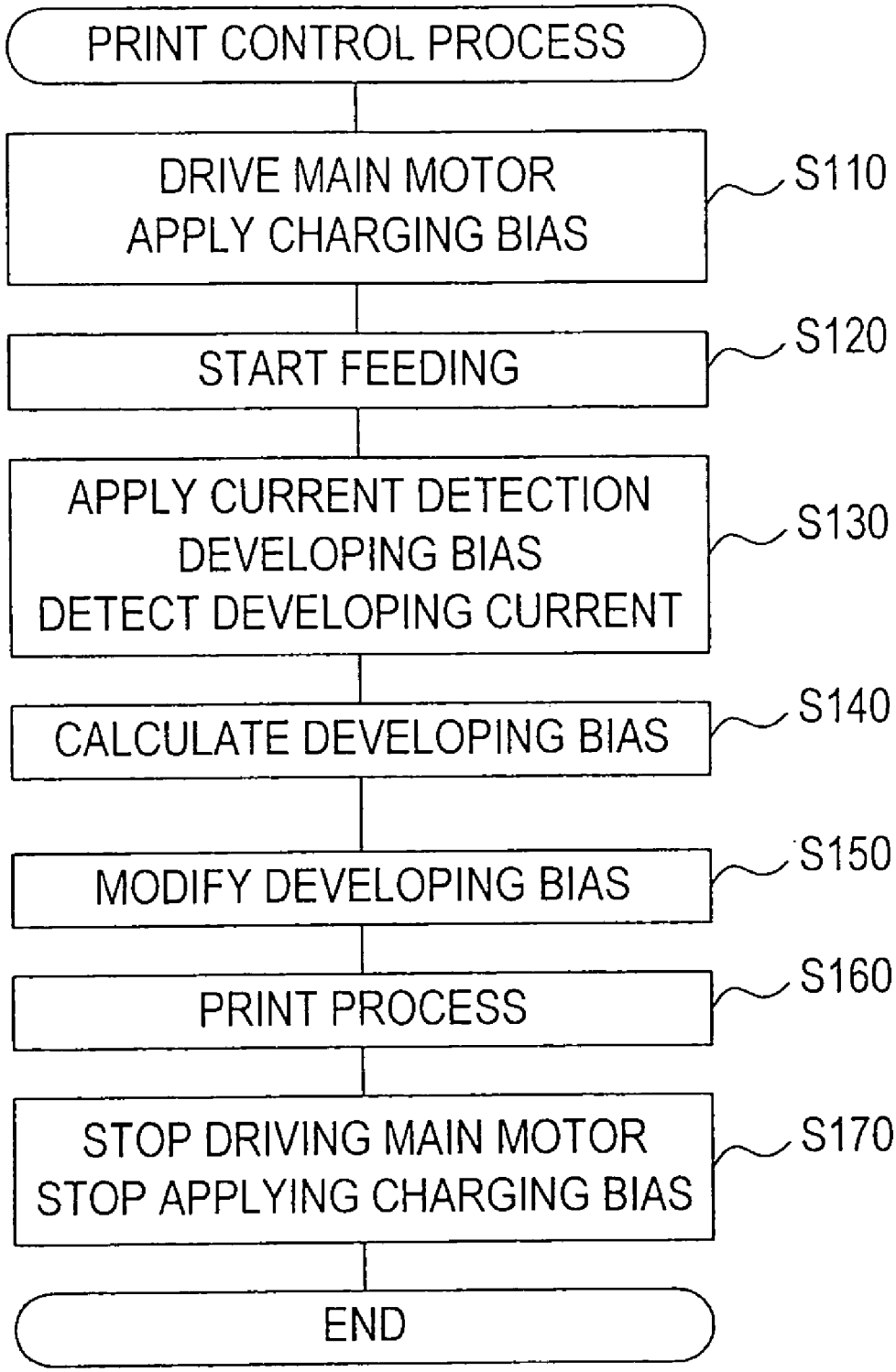
FIG. 8 is a flowchart of a print control process executed in the laser printer according to the embodiment.

A print control process performed by the CPU 70 is described hereafter by way of the flowchart shown in FIG. 8. The print control process is started when the CPU 70 receives image data (print data) transmitted from an external personal computer.

When the print control process is started, instructions to drive the main motor 67 are given to the main motor driving controller 68 via the I/O interface 73 in S110. Also, instructions to apply the charging bias to the scorotron charger 29 are given to the charged bias controller 62 via the I/O interface 73. Thereby, the main motor 67 is driven and the photosensitive drum 27 and the heating roller 41 start rotation. Also, charging to the photosensitive drum 27 is started by the scorotron charger 29. Instructions to make the scanner unit 16 ready for carrying out exposure is given to the laser irradiation controller 63 via the I/O interface 73. As a result, a polygon motor is started and a laser source is lighted in order to check whether the scanner unit 16 has started normally. After an operation called BD check is performed, the laser source becomes capable of controlling exposure.

In S120, instructions to feed the paper P (i.e. a trigger signal to a feed solenoid for starting the rotational drive of the feed roller 8) are given to the feed mechanism controller 69.

In S130, instructions to apply a predetermined current detection developing bias Vb0 to the developing roller 31 for a predetermined period of time, as a value for use in detecting the developing current, are given to the developing bias control portion 64 via the I/O interface 73. This current detection developing bias Vb0 is the predetermined value set so as to obtain the aforementioned equation (3). That is, the current detection developing bias Vb0 is adjusted so as to obtain the Q/M by using the equation (3).

The predetermined period of time, during which the current detection developing bias Vb0 is applied, is set as such that application of the current detection developing bias Vb0 is terminated before the development of the electrostatic latent image formed by exposure from the scanner unit 16 is started. In other words, the scorotron charger 29 is adapted to start charging at a timing earlier than at least a passing timing of a head part of the image forming area in which the electrostatic latent image is formed by the scanner unit 16. In S130, the current detection developing bias Vb0 is applied during the print operation, during a period not including the period for the BD check after charging by the scorotron charger 29 is started, before the electrostatic latent image formed by exposure from the scanner unit 16 reaches a developing area, and within a period excluding the period necessary for modifying the developing bias. Also, the predetermined period of time is set longer than the time required for the photosensitive drum 27 to make one revolution.

In S130, during the application of the current detection developing bias Vb0, the current value of the developing current (i.e., non-image portion developing current Iw) is detected by the developing current sensor 61. Particularly, while the photosensitive drum 27 makes one revolution, a plurality of current values are detected at a plurality of different rotating positions of the photosensitive drum 27 (i.e., a plurality of contact positions between the photosensitive drum 27 and the developing roller 31), and the values are averaged. In this manner, reliability of the detected value is enhanced, without being affected by the eccentricity of the photosensitive drum 27 and possible changes in characteristics in a circumferential direction of the surface of the photosensitive drum 27, or misdetection.

In S140, the developing bias to be applied to the developing roller 31 in order to maintain regular density of the printed image (hereafter, referred to as "printing developing bias") is calculated.

Particularly, the developing current Iw detected in S130 is substituted in the equation (3) in order to calculate the Q/M of the toner. That is, in the laser printer 1 of the present embodiment, the developing current Iw is detected as the Q/M of the toner.

Subsequently, based on the calculated Q/M of the toner and the target transmission density D of the toner image which corresponds to the target image density and the aforementioned equation (1) stored in the ROM 71, the developing current I applied in order to obtain the target transmission density D (i.e., the developing current applied when developing the toner image representing the reference image) is calculated.

The calculated developing current I is substituted in the aforementioned equation (2) stored in the ROM 71 so that the developing bias Vb required to obtain this developing current I is calculated.

In S150, the printing developing bias currently set is modified to the developing bias Vb calculated in S140.

In S160, a print process for printing an image representing the image data on the paper P fed in S120 is performed. Particularly, instructions for the scanner unit 16 to expose the photosensitive drum 27 for forming the electrostatic latent image corresponding to the image data thereon are given to the laser radiation controller 63. Also, instructions to apply the currently set printing developing bias to the developing roller 31 are given to the developing bias controller 64 in order to develop the electrostatic latent image on the photosensitive drum 27 and form the toner image. Moreover, instructions to apply to the transfer roller 30 the transfer bias for transferring the toner image formed as above on the conveyed paper P are given to the transfer bias controller 65. Furthermore, instructions to set the temperature of the heating roller 41 to a predetermined heat fixing temperature for fixing the toner image on the paper P are given to the fixing temperature controller 66.

When the feed sensor 60 detects the rear edge of the paper P during the print process, the process moves to S170. Instructions Lo stop driving the main motor 67 are given to the main motor drive controller 68 via the I/O interface 73. Instructions to stop applying the charging bias to the scorotron charger 29 are also given to the charging bias controller 62 via the I/O interface 73. Thereby, rotational drive of the main motor 67 is terminated and rotation of the photosensitive drum 27 and the heating roller 41 is also terminated. Charging to the photosensitive drum 27 by the scorotron charger 29 is also terminated. The print control process is ended.

Only a case of printing one sheet of paper is described in the above. In the case of printing a plurality of sheets continuously, the next sheet is fed during the print control process. After the print process for one sheet is ended, the developing bias detection process for the next sheet is performed during a transition from one sheet to another. However, the predetermined period of time during which the developing current detection is performed at this time is set shorter than the period of time required for one revolution of the photosensitive drum 27. This is for the purpose of placing a priority on the printing speed in continuous printing. However, if placing a priority on the stability of density is preferred, it is appropriate to set the detection time sufficient for one revolution of the photosensitive drum 27, giving an interval between each sheet. That is, the developing bias is adjusted for each sheet.

Figure 17:
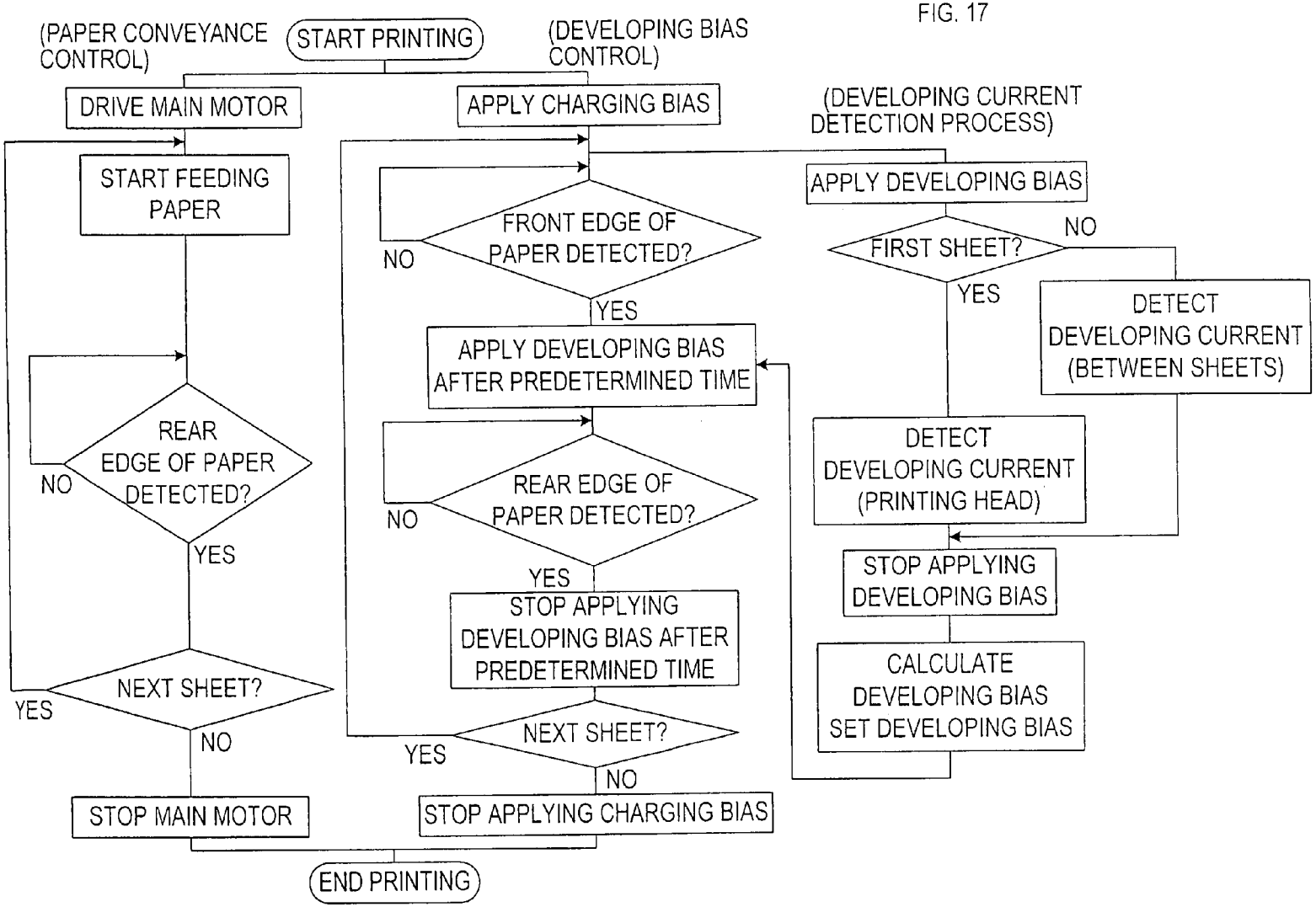
FIG. 17 is a flowchart showing the flow in FIG. 8 in more detail.

FIG. 8 shows a schematic flow of the print control process. More particularly, however, it is desirable that a paper conveyance control and a developing bias control are processed in parallel, as shown in the flowchart of FIG. 17.

Figure 9:
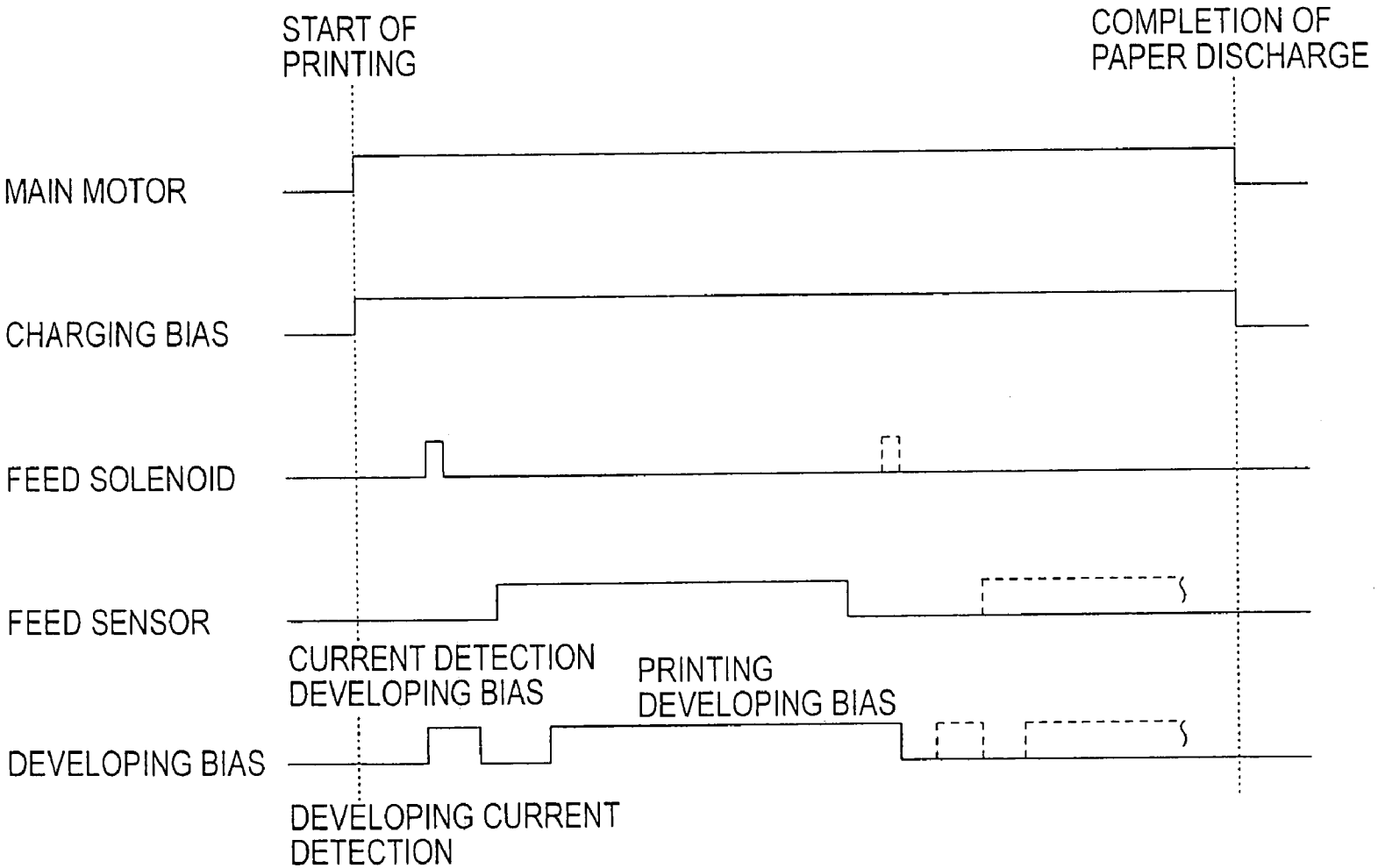
FIG. 9 is a time chart for explaining the operation of the laser printer according to the embodiment.

Operation of the laser printer 1 is described by way of a time chart in FIG. 9.

When the print operation is started, the main motor 67 is driven and the charging bias is applied to the scorotron charger 29 in order to charge the surface of the photosensitive drum 27 (S110). Then, feeding of the paper P is started (S120). Before developing, the current detection developing bias Vb0 is applied to the developing roller 31 for the predetermined period of time, during which the developing current Iw is detected (S130). From the detected developing current Iw, the Q/M of the toner is obtained (by way of equation (3)). Furthermore, the developing bias Vb which regulates the ratio of the Q/M to the developing current I at the time that the electrostatic latent image representing the reference image is developed (that is, the developing bias Vb which allows the toner image to have a target transmission density D) is calculated (by way of equations (1) and (2)). The printing developing bias is adjusted to the developing bias Vb. During printing, the printing developing bias is applied after the adjustment and the toner image is then formed. As a result, an image having the proper density is printed (S160). In FIG. 9, an example of continuous printing of a plurality of sheets is shown by the dotted lines, in which the period of time for the developing bias detection process, during a transition from one sheet to another, is set shorter than the period of time for the detection process before printing the first sheet (shown as a printing head detection process in FIG. 17) for the purpose of placing a priority on the printing speed.

As described above, the laser printer 1 of the present embodiment allows the printing of an image having proper density even if the Q/M of the toner is changed. Also in the laser printer 1, the Q/M of the toner is indirectly measured by detecting the developing current at the time of non-developing. Therefore, the laser printer 1 of the present embodiment can be configured at a low cost as compared to a case in which the Q/M of the toner is directly detected using a device like an electric potential sensor. Furthermore, the laser printer 1 does not require formation of a toner image (patch) exclusive for density detection, as in a laser printer using conventional calibration. Therefore, the waste of toner can be avoided. In addition, a process for adjusting the developing bias can be performed in a short period of time.

In the laser printer 1, during the print operation after charging by the scorotron charger 29 and before developing of the electrostatic latent image by the developing device, the developing current is detected to adjust the developing bias. Therefore, start of the print operation is not delayed. Especially, the developing bias is adjusted for each sheet of paper P. Therefore, the laser printer 1 of the present embodiment is able to react to changes in the Q/M during the printing of a plurality of sheets of paper P.

According to the laser printer 1, even if the change in the Q/M is large, it is possible to properly maintain the density of the printed image.

In the above, one embodiment of the present invention has been described. However, other modifications and variations may be possible without departing from the technical scope of the invention.

For instance, in the laser printer 1 of the present embodiment, even at the time of printing a plurality of sheets of paper P, the developing bias is adjusted per each sheet of paper P. However, for example, in cases in which the same image is printed on a plurality of sheets of paper P, the developing bias may be fixed.

In the laser printer 1, the three equations (1) to (3) are stored in the ROM 71. However, for example, only one equation which incorporates the above three equations may be stored. Or, the equations may be stored as a table.

In the laser printer 1, in order to adjust the developing bias, the electric potential of the developing roller 31 is adjusted. However, for example, the latent image potential in the photosensitive drum 27 may be adjusted by adjusting the irradiation strength of the laser beam emitted from the scanner unit 16 (i.e., the irradiation strength of the laser beam by the laser irradiation portion). For example, the latent image potential may be adjusted by the adjustment of the charging bias applied to the scorotron charger 29 and the adjustment of the charging potential in the photosensitive drum 27.

Use of the present invention is not limited to a monochrome laser printer. In the case of a color laser printer, for example, the constants in the respective equations (1) to (3) are determined for black and other color developers to detect each developing current Iw for each color.

In the laser printer 1 of the above embodiment, during the print operation and after charging by the scorotron charger 29 is started, exposure by the scanner unit 16 is started. Before developing the electrostatic latent image, the developing current is detected. However, there are other methods for detecting the developing current.

A laser printer, in general, performs initialization as a preparatory operation to start the print operation (particularly, for the purpose of raising the temperature of the heating roller 41 in the fixing unit 18, agitating the toner using the agitator 36 for stabilized charging, etc), immediately after the power is on, or after a long period of time during which no print operation is performed even if the power is on. Therefore, detection of the developing current may be performed during such initialization.

Figure 10:
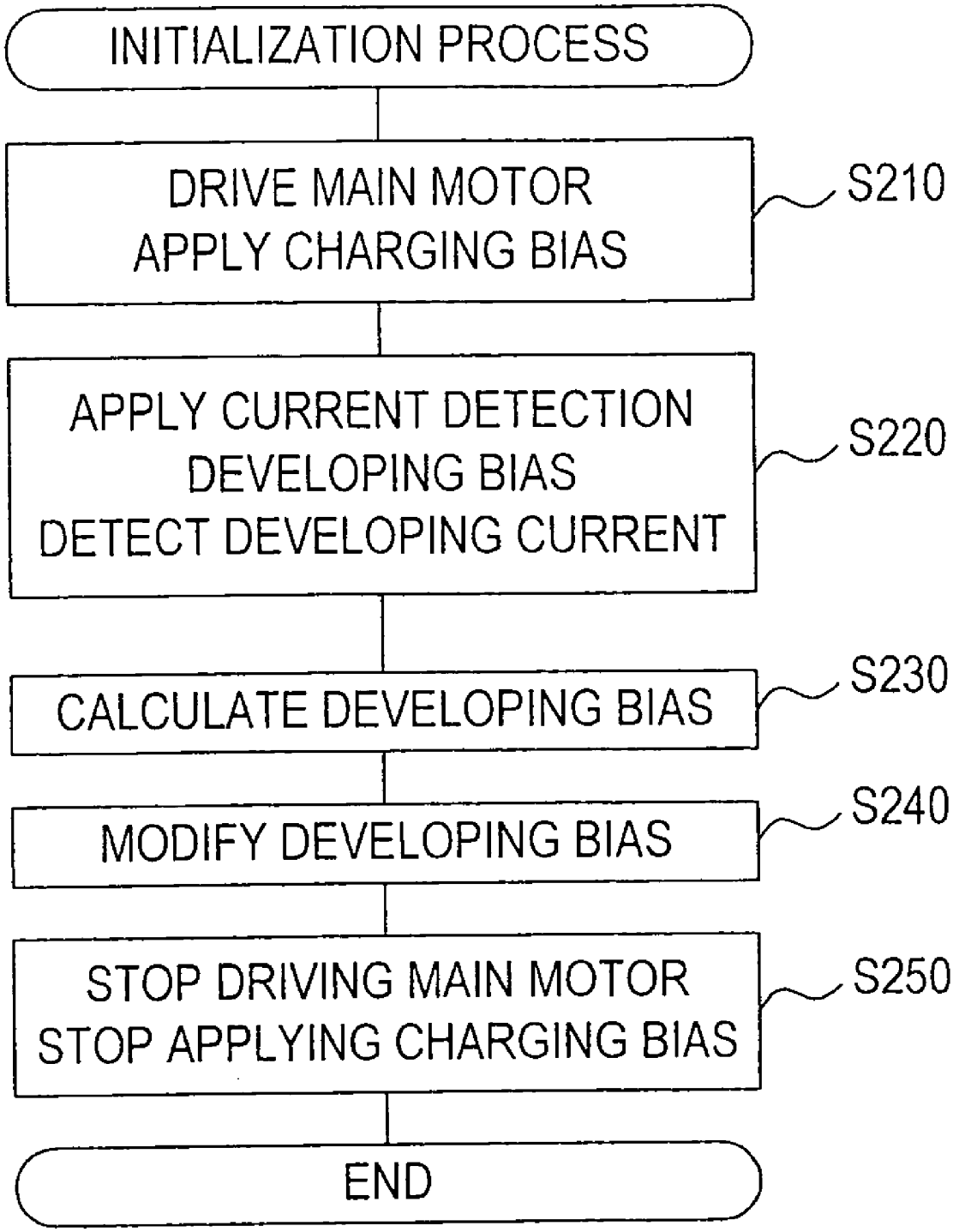
FIG. 10 is a flowchart of an initialization process.
Figure 11:
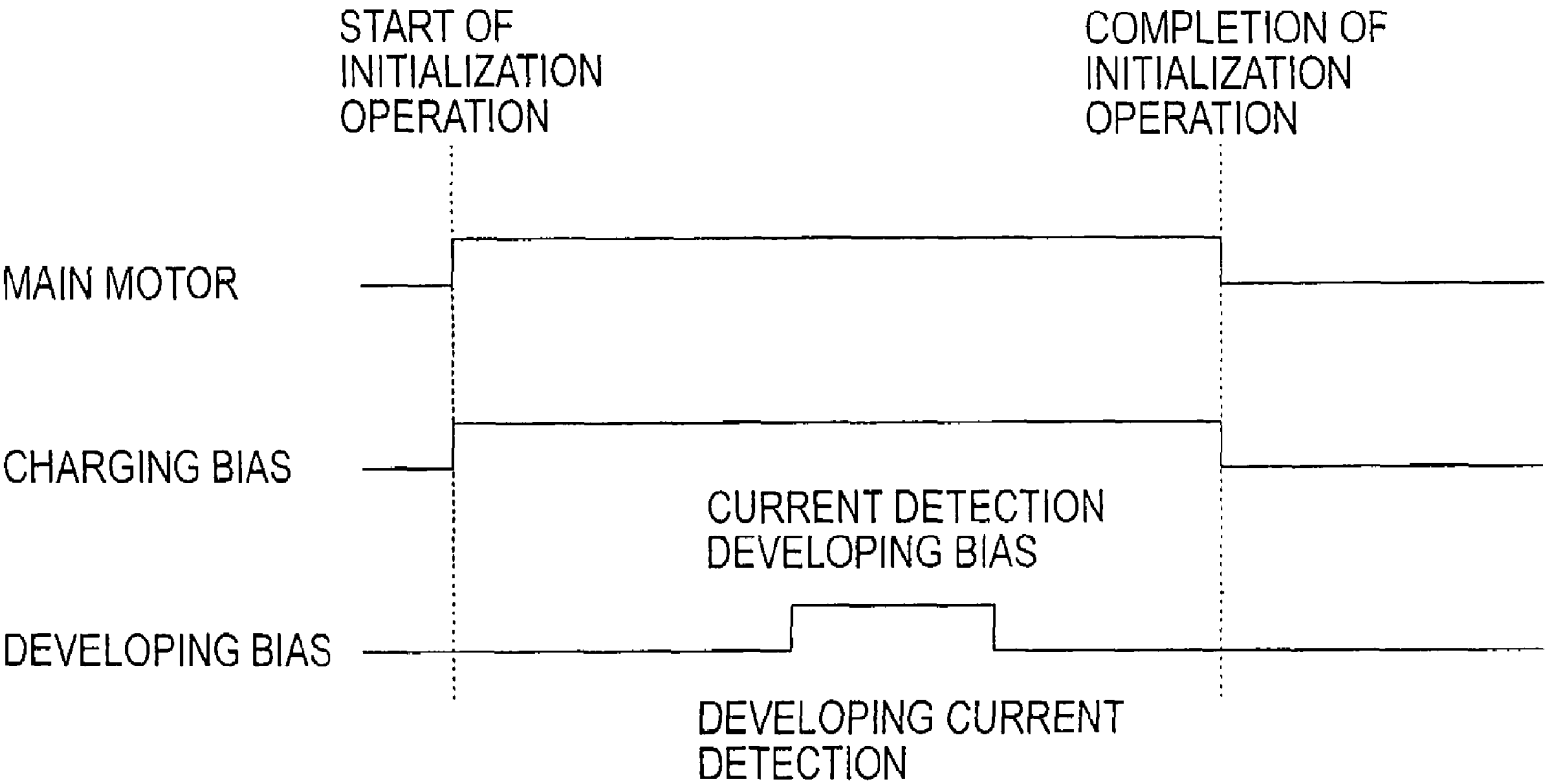
FIG. 11 is a time chart for explaining the operation accompanying the initialization process.

An initialization process performed by the CPU 70 to achieve the above operation is explained by way of a flowchart in FIG. 10. A time chart of the operation is shown in FIG. 11. The initialization process is started when the power of the laser printer 1 is switched on, and when the image data is received after a predetermined period of time has passed since the previous print operation.

When the initialization process is started, instructions to drive the main motor 67 are given to the main motor driving controller 68 via the I/O interface 73 in S210. Instructions to apply the charging bias to the scorotron charger 29 are also given to the charging bias controller 62 via the I/O interface 73. Thereby, the initialing operation is started. The main motor 67 is driven and the charging bias is applied to the scorotron charger 29 (FIG. 11). Particularly, the photosensitive drum 27 and the heating roller 41 start rotation via the drive of the main motor 67. Charging the photosensitive drum 27 by the scorotron charger 29 is also started. A heater included in the heating roller 41 in the fixing unit 18 is switched on to raise the temperature of the heating roller 41.

In S220, instructions to apply the predetermined current detection developing bias Vb0 (as the value for use in detecting the developing current) to the developing roller 31 for a predetermined period of time are given to the developing bias controller 64 via the I/O interface 73.

The timing to start the application of the current detection developing bias Vb0 and the predetermined period of time during which the current detection developing bias Vb0 is applied are set as such that application of the current detection developing bias Vb0 is completed before the initialization is completed. That is, during the initialization, the application of the current detection developing bias Vb0 is performed (FIG. 11). Also, the predetermined period of time is set longer than the time required for the photosensitive drum 27 to make one revolution.

In S220, during the application of the current detection developing bias Vb0, the current value of the developing current (i.e., the non-image portion developing current Iw) is detected by the developing current sensor 61. Particularly, during one revolution of the photosensitive drum 27, a plurality of current values at a plurality of different rotating positions of the photosensitive drum 27 (i.e., contact positions between the photosensitive drum 27 and the developing roller 31) are detected and averaged. In this manner, the reliability of the detected value is improved without being affected by unusually biased values or misdetection.

In S230, using the developing current Iw detected in S220, the printing developing bias Vb is calculated in the same manner as in S140 in the print control process of the aforementioned embodiment (FIG. 8).

In S240, the printing developing bias currently set is modified to the developing bias Vb calculated in S230.

In S250, instructions to terminate the drive of the main motor 67 are given to the main motor driving controller 68 via the I/O interface 73. Instructions to terminate the application of the charging bias to the scorotron charger 29 are given to the charging bias controller 62 via the I/O interface 73. The initialization process is then ended. Thereby, the drive of the main motor 67 is terminated, and the application of the charging bias to the scorotron charger 29 is terminated (FIG. 11). Particularly, rotation of the photosensitive drum 27 and the heating roller 41 is terminated. Charging of the photosensitive drum 27 by the scorotron charger 29 is also terminated.

As in the above, the initialization process described by way of FIGS. 10 and 11 allows adjustment of the developing bias without delaying the start of the print operation, since detection of the developing current is performed during the initialization process. Accordingly, sufficient time for detecting the developing current is secured, as compared to a configuration in which the developing current is detected before exposure of image data by the scanner unit 16, as in the above embodiment. Other than the initialization process, if the apparatus performs operation in which the photosensitive drum 27 is rotated but exposure by the scanner unit 16 is not performed (such as a pre-process or a post-process for printing), detection of the developing current may be performed during such an operation.

On the other hand, detection of the developing current may be performed during the print operation, after exposure of the image data by the scanner unit 16 and developing of the electrostatic latent image by the developer is terminated, and before charging by the scorotron charger 29 is terminated.

Figure 12:
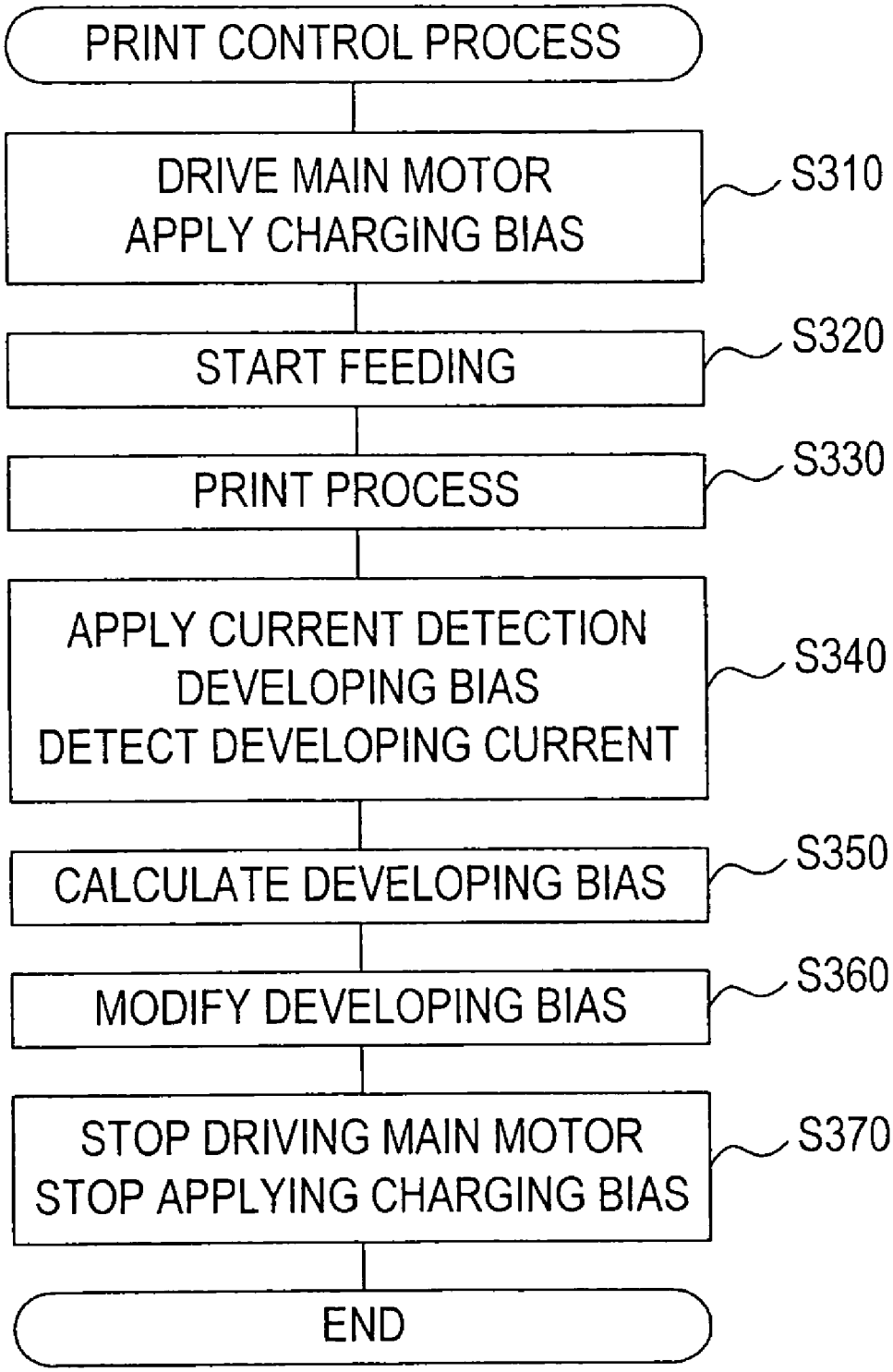
FIG. 12 is a flowchart showing a variation of the print control process.
Figure 13:
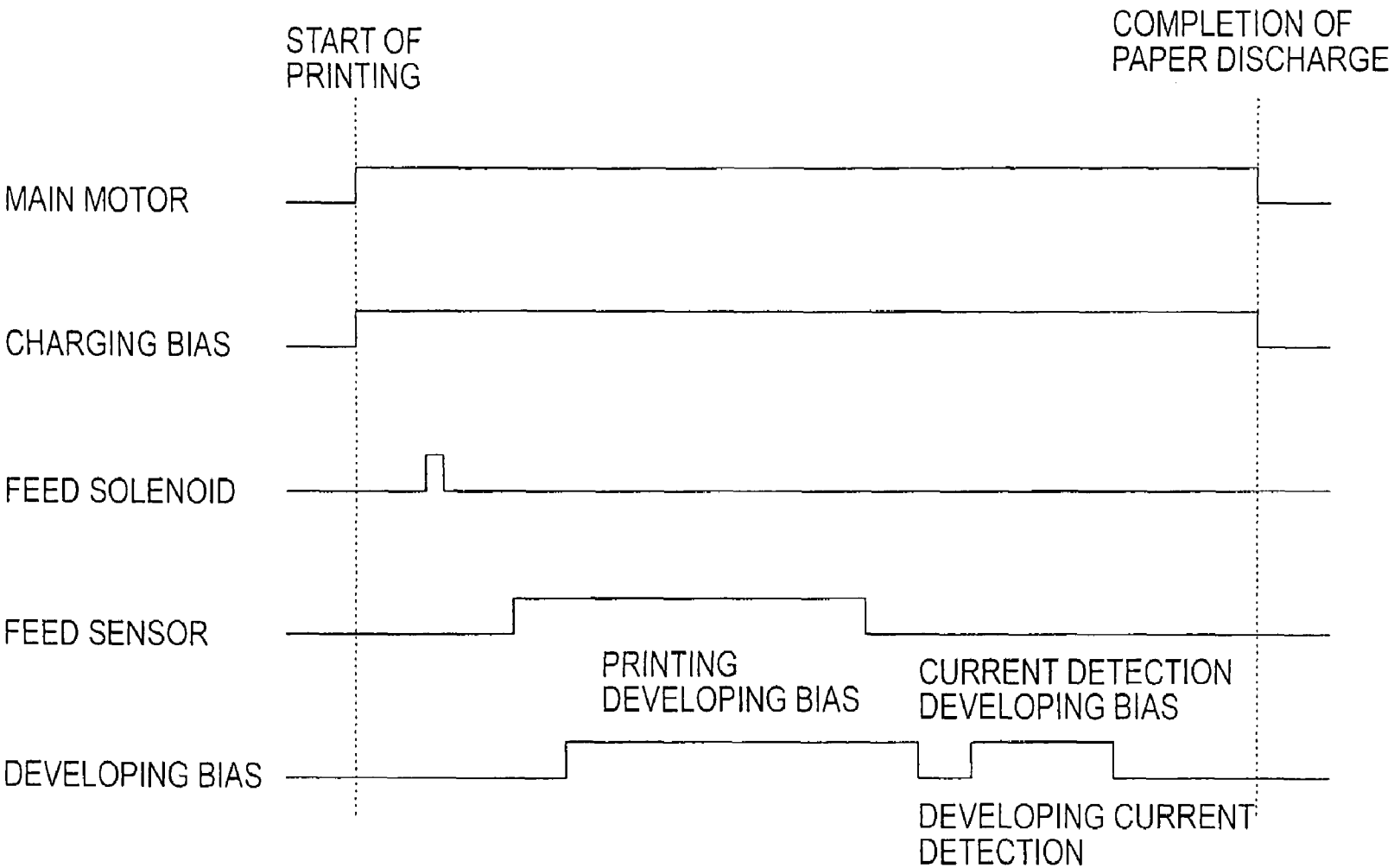
FIG. 13 is a time chart for explaining the operation accompanying the variation of the print control process.

A print control process performed by the CPU 70, instead of the print control process of the aforementioned embodiment (FIG. 8), in order to achieve the above operation, is described by way of a flowchart in FIG. 12. A time chart in the operation is shown in FIG. 13.

When the print control process is started, instructions to drive the main motor 67 are given to the main motor driving controller 68 via the I/O interface 73 in S310. Also, instructions to apply the charging bias to the scorotron charger 29 are given to the charged bias controller 62 via the I/O interface 73. Thereby, the print operation is started. The main motor 67 is driven and the charging bias is applied to the scorotron charger 29 (FIG. 13). Particularly, the photosensitive drum 27 and the heating roller 41 start rotation. Also, charging to the photosensitive drum 27 by the scorotron charger 29 is started.

In S320, instructions to feed the paper P are given to the feed mechanism controller 69.

In S330, a print process for printing an image representing the image data on the fed paper P in S320 is performed. The print process is performed in the same manner as S160 in the print control process of the aforementioned embodiment (FIG. 8).

When the print process is ended, the process moves to S340. Instructions to apply the current detection developing bias Vb0, predetermined as the value for use in detecting developing current, to the developing roller 31 for a predetermined period of time are given to the developing bias controller 64 via the I/O interface 73.

The predetermined period of time during which the current detection developing bias Vb0 is applied is set as such that application of the current detection developing bias Vb0 is terminated before charging by the scorotron charger 29 is terminated. In other words, the scorotron charger 29 is designed to terminate charging at a time later than at least the passing time of the tail part of the image forming area where the electrostatic latent image is formed by the scanner unit 16 at the time of the print operation. In S340, application of the current detection developing bias Vb0 is performed during the print operation, and within a period after exposure of the image data by the scanner unit 16 and developing of the formed electrostatic latent image by the developer is terminated and before the tail part charged by the scorotron charger 29 passes the developing roller 31 (i.e., developing nip portion) (FIG. 13). Also, the predetermined period of time is set longer than the time required for the photosensitive drum 27 to make one revolution.

In S340, during the application of the current detection developing bias Vb0, the current value of the developing current (i.e., non-image portion developing current Iw) is detected by the developing current sensor 61. Particularly, while the photosensitive drum 27 makes one revolution, current values at a plurality of different rotating positions of the photosensitive drum 27 are detected and averaged. In this manner, the reliability of the detected value is enhanced, without being affected by the eccentricity of the photosensitive drum 27 and possible changes in characteristics in a circumferential direction of the surface of the photosensitive drum 27, or misdetection.

In S350, using the developing current Iw detected in S340, the printing developing bias Vb is calculated as in the same manner as S140 in the print control process of the aforementioned embodiment (FIG. 8).

In S360, the currently set printing developing bias is modified to the developing bias Vb calculated in S350.

In S370, instructions to stop driving the main motor 67 are given to the main motor driving controller 68 via the I/O interface 73. Also, instructions to stop application of the charging bias to the scorotron charger 29 are given to the charging bias controller 62 via the I/O interface 73. The present print control process is then ended. Thereby, the drive of the main motor 67 is terminated, and application of the charging bias to the scorotron charger 29 is terminated to end the print operation (FIG. 13). Particularly, rotation of the photosensitive drum 27 and the heating roller 41 is terminated as the main motor 67 stops driving. Also, charging of the photosensitive drum 27 by the scorotron charger 29 is terminated.

Only a case of printing one sheet of paper is described in the above. In case of printing a plurality of sheets continuously, the next sheet is fed during the print control process in the same manner as in the description made for FIG. 8. After the print process is ended, the developing bias detection process for the next sheet is performed during the transition from one sheet to another. After the print process for the last sheet has ended, the developing current Iw is detected to calculate the printing developing bias Vb in the same manner as in a case of the aforementioned process of only printing one sheet. After the set value is changed, termination of the main motor and charging is performed. If the predetermined period of time during which the developing current detection is performed in a transition from one sheet to another is set shorter than the period of time required for one revolution of the photosensitive drum 27, it is possible to place a priority on the printing speed in continuous printing. However, if placing a priority on the stability of density is preferred, it is appropriate to set a detection time sufficient for one revolution of the photosensitive drum 27, providing an interval in the transition of one sheet to another. FIG. 12 shows a schematic flow of the print control process, similar to the flow in FIG. 8. Particularly, however, it is preferable that the paper conveyance control and the developing bias control are processed in parallel as in a flowchart shown in FIG. 18.

Figure 18:
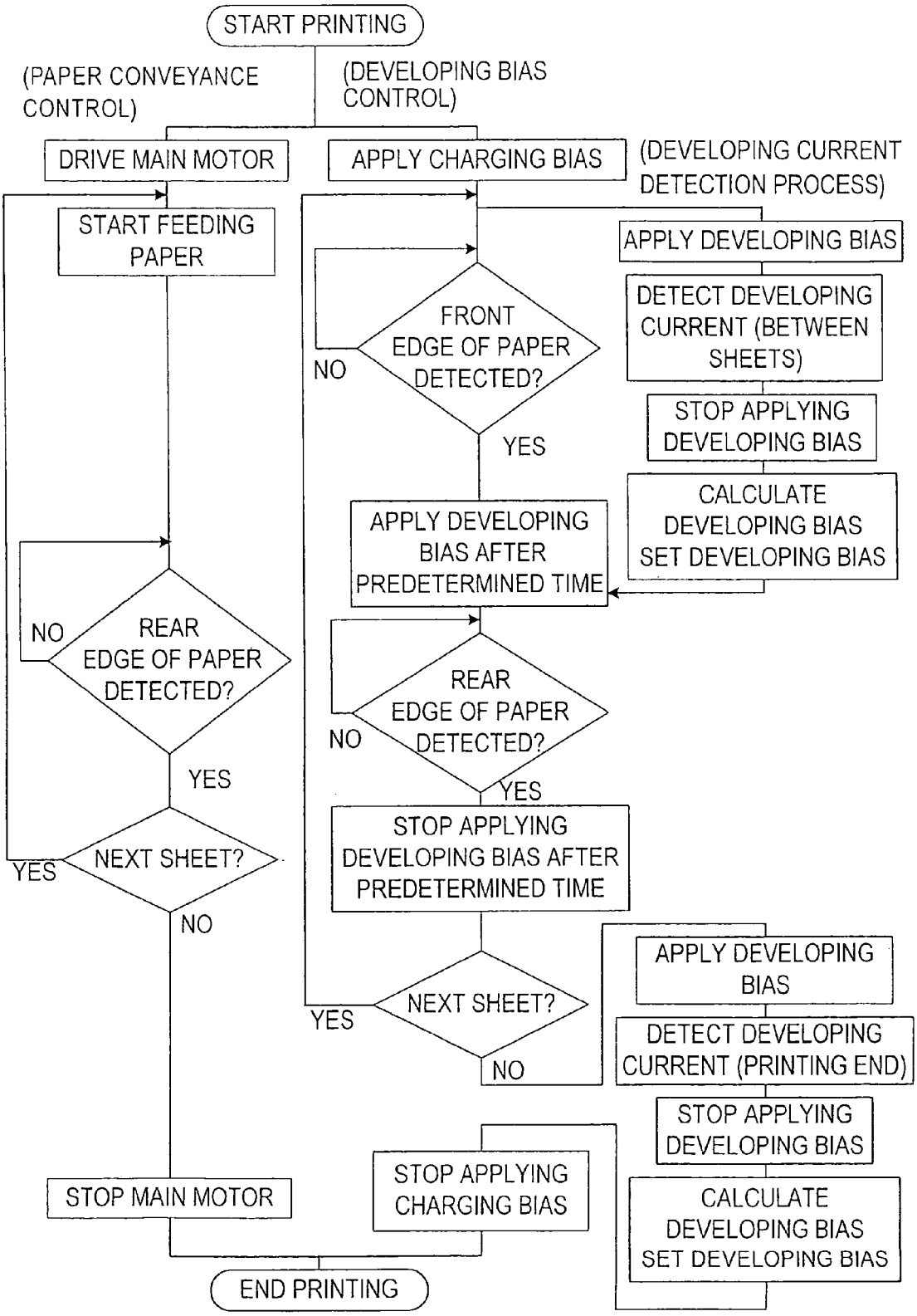
FIG. 18 is a flowchart showing the flow in FIG. 12 in more detail.
Figure 19:
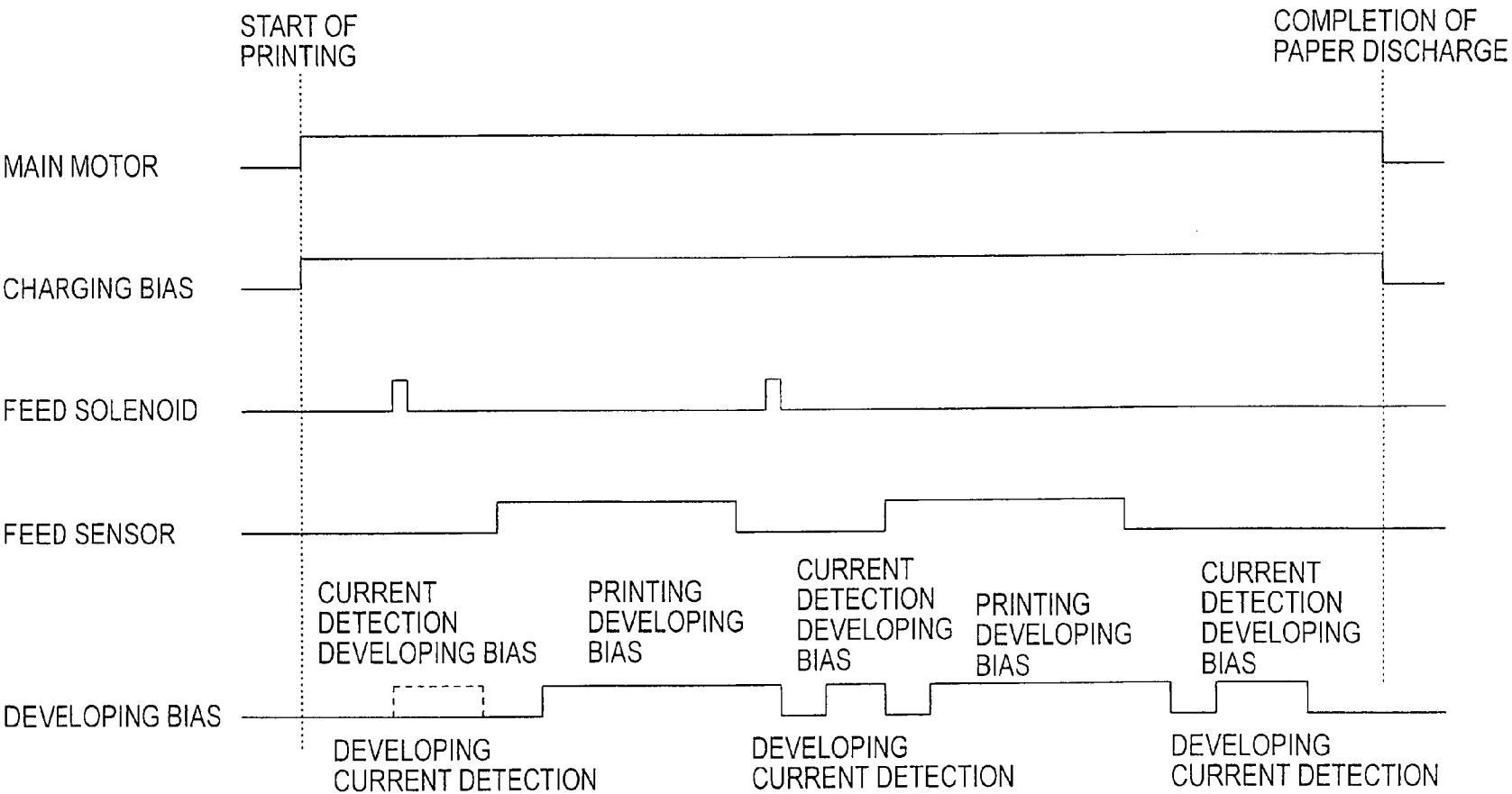
FIG. 19 is a time chart, similar to FIG. 13, showing an example of continuous printing.

In an example shown in FIG. 18, in addition to the process of detecting the developing current after developing of one sheet is ended, detection of the developing current is performed before printing is started. Therefore, it is possible to adjust the printing developing bias for use in printing the first sheet. FIG. 19 shows an example of the continuous printing of two sheets. In addition to the detection process performed in the transition of one paper to another and after the print process, the detection process before the start of printing is also indicated by the dotted lines.

As above, in the print control process explained by way of FIGS. 12 and 13, the developing current is detected during the print operation, after exposure of the image data by the scanner unit 16 and developing of the formed electrostatic latent image by the developer are terminated, and before charging by the scorotron charger 29 is terminated, for adjustment of the developing bias. Therefore, the start of the print operation is not delayed. Particularly, the developing bias is adjusted per each sheet of paper P so that the laser printer 1 of the present embodiment is able to respond to changes in the Q/M during the printing of a plurality of sheets of paper P.

Furthermore, detection of the developing current is performed after the termination of developing. Accordingly, sufficient time for detecting the developing current is secured, as compared to a configuration in which the developing current is detected before exposure by the scanner unit 16 as in the above embodiment.

In the laser printer 1, the Q/M is detected indirectly by detecting the developing current. However, the Q/M may be directly detected.

Figure 14:
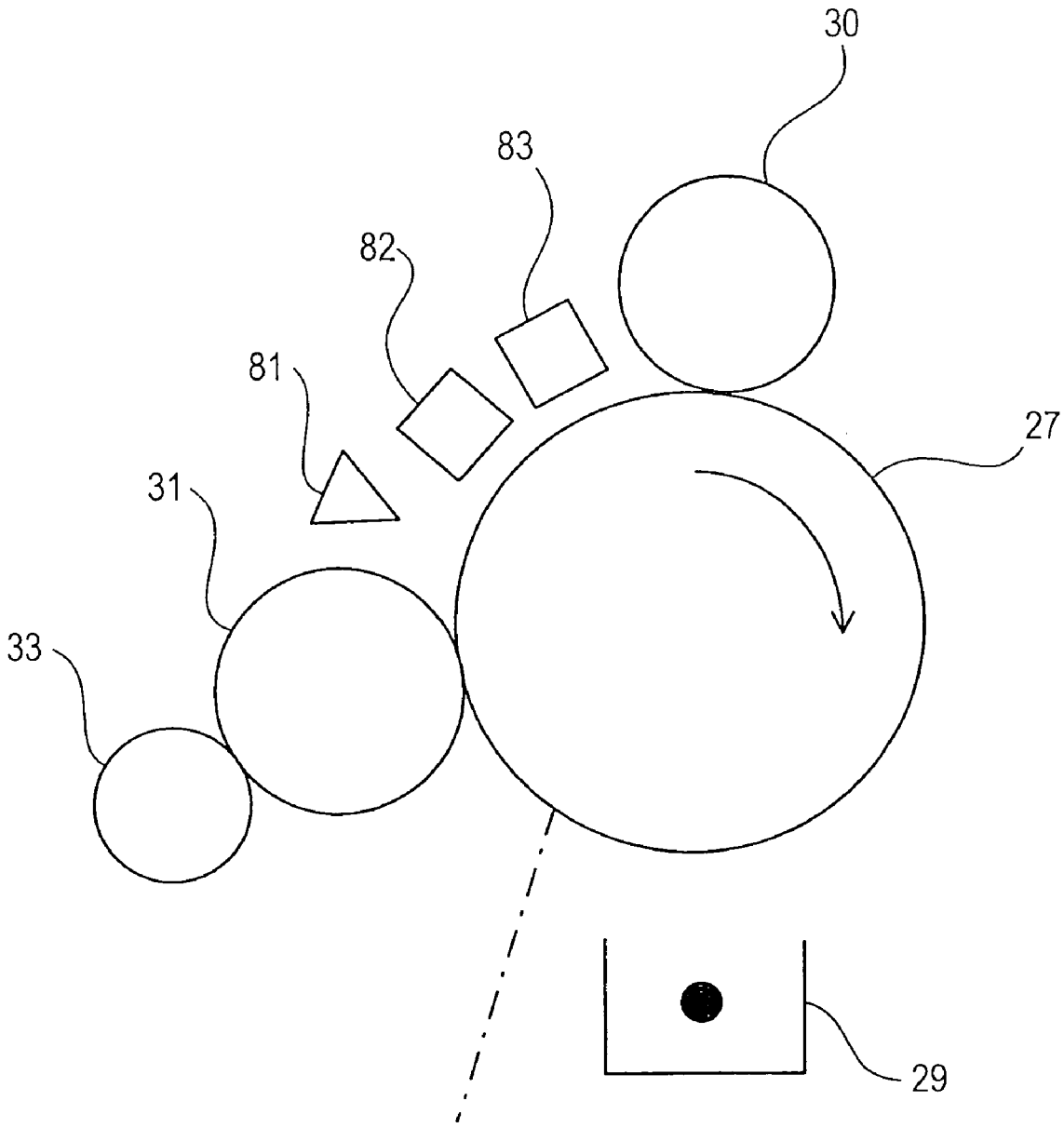
FIG. 14 is an explanatory view describing a configuration near a photosensitive drum in a variation of the laser printer.
Figure 15:
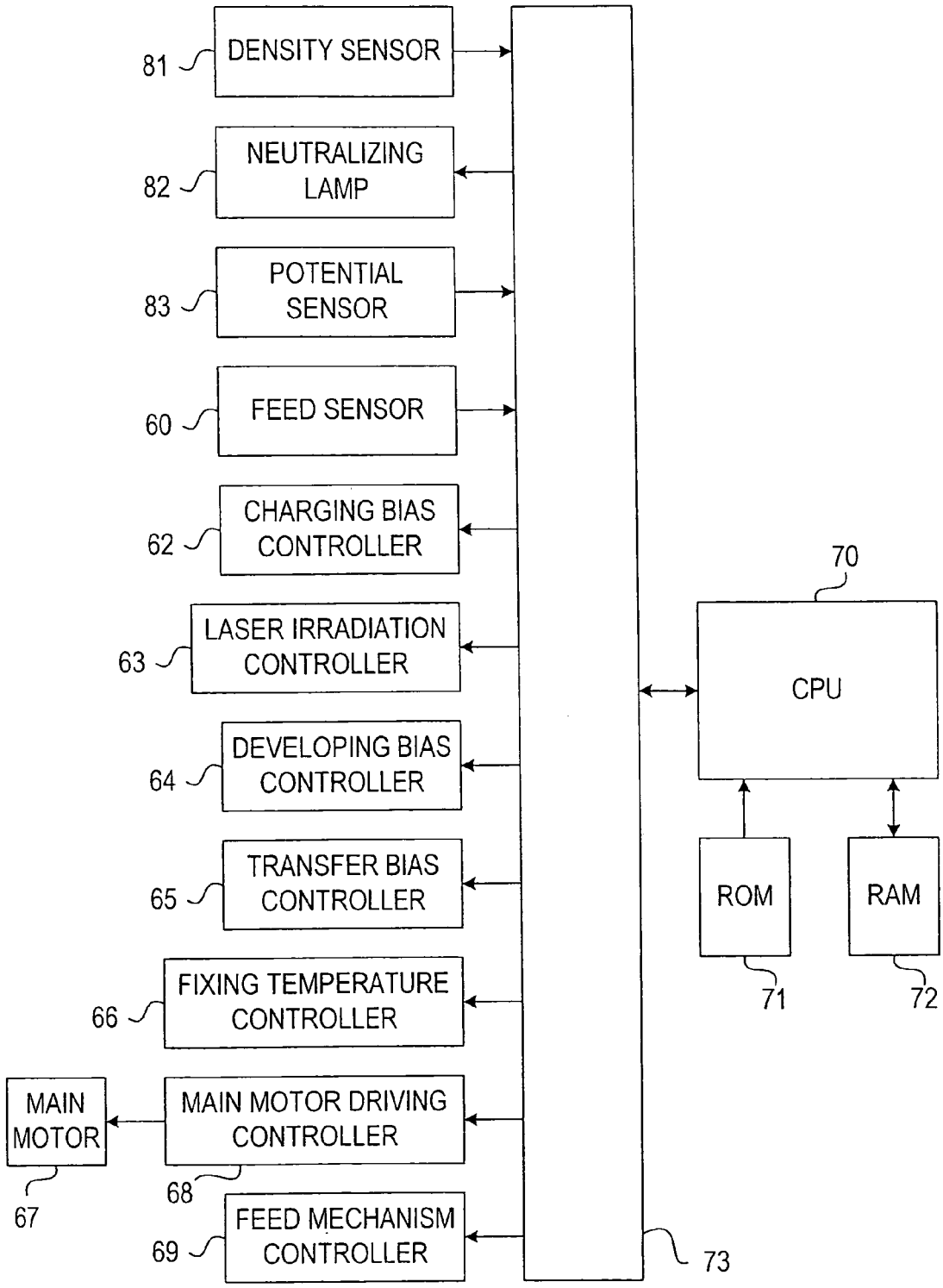
FIG. 15 is a block diagram showing the electric configuration of a variation of the laser printer.
Figure 16:
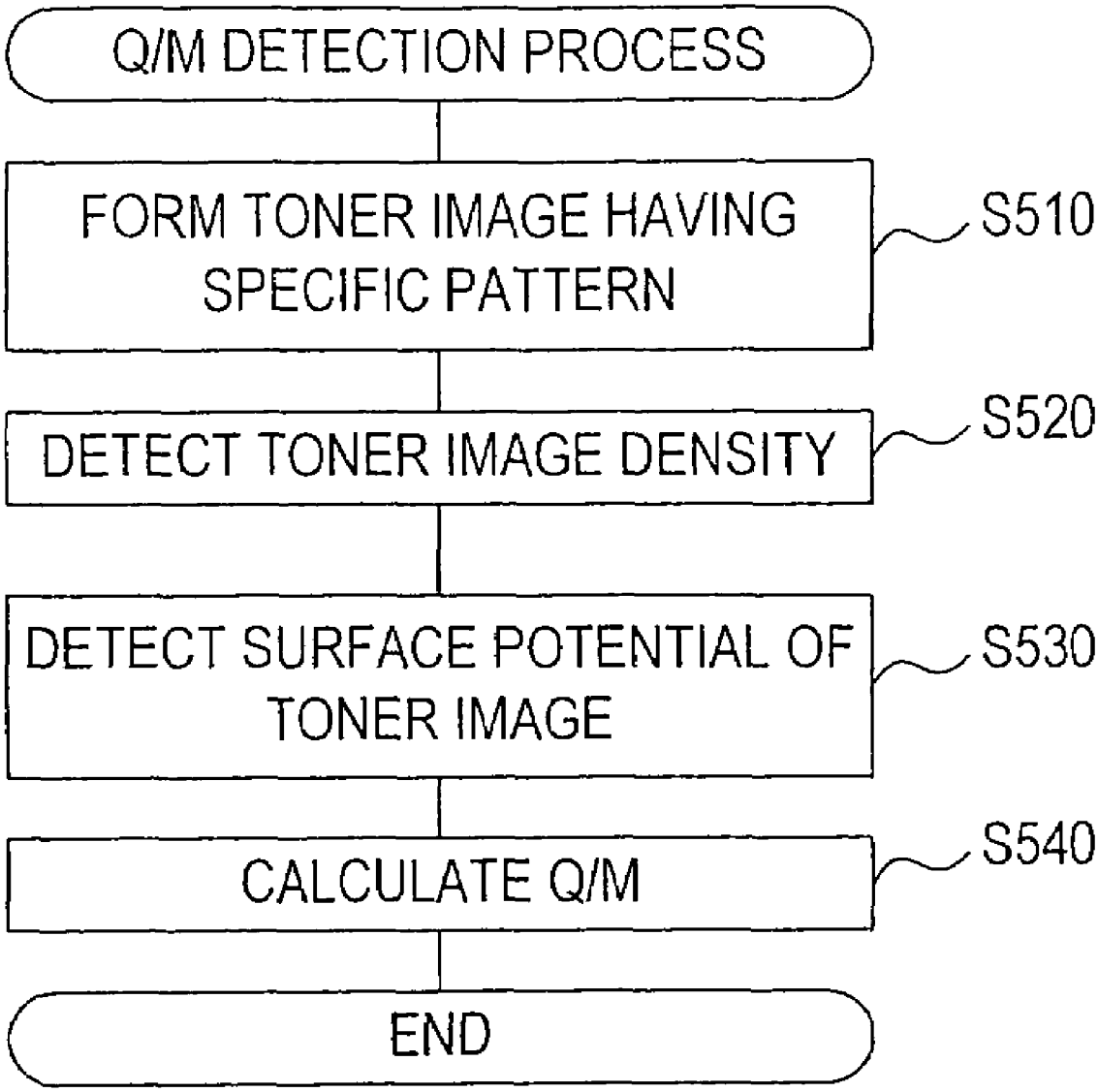
FIG. 16 is a flowchart of the Q/M detection process executed in a variation of the laser printer.

An embodiment of a laser printer in which the Q/M is directly detected is described by way of FIGS. 14 to 16.

FIG. 14 is an explanatory view for explaining the configuration near the photosensitive drum 27 in the laser printer of the present embodiment. FIG. 15 is a block diagram showing an electric configuration of this laser printer.

As shown in FIGS. 14 and 15, in addition to the components of the laser printer 1 of the above embodiment, the present laser printer comprises a density sensor 81, a neutralizing lamp 82, and a potential sensor 83. The developing current sensor 61 in the laser printer 1 is not necessary in the present laser printer.

The density sensor 81 is provided downstream of a facing position between the photosensitive drum 27 and the developing roller 31 (i.e., at a downstream side along a rotational direction of the photosensitive drum 27), and upstream of a facing position between the photosensitive drum 27 and the transfer roller 30, in a manner facing the photosensitive drum 27. The density sensor 81 includes, but are not shown, a light source that emits infrared light, a lens that irradiates the light from the light source onto the photosensitive drum 27, and a photo transistor that receives the light reflected on the photosensitive drum 27. The density sensor 81, based on the reflected light when the light is irradiated on the toner image formed on the photosensitive drum 27, detects the density of the toner image.

The neutralizing lamp 82 is provided downstream of a facing position between the photosensitive drum 27 and the density sensor 81, and upstream of the facing position between the photosensitive drum 27 and the transfer roller 30, in a manner facing the photosensitive drum 27. The neutralizing lamp 82 neutralizes only the latent image electric charge without neutralizing the toner, by irradiating light to the photosensitive drum 27.

The potential sensor 83 is provided downstream of a facing position between the photosensitive drum 27 and the neutralizing lamp 82, and upstream of the facing position between the photosensitive drum 27 and the transfer roller 30, in a manner facing to the photosensitive drum 27. The potential sensor 83 detects the surface potential of the photosensitive drum 27.

A Q/M detection process performed by the CPU 70 for detecting the Q/M is explained by way of a flowchart in FIG. 16.

When the Q/M detection process is started, a toner image representing an image having a specific pattern is formed on the photosensitive drum 27 in S510.

In S520, density of the toner image formed in S510 is detected by the density sensor 81. From the density of the toner image, an adhesion amount of the toner can be determined.

In S530, the surface potential of the toner image formed in S510 is detected by the potential sensor 83. That is, because of the neutralizing lamp 82, only the electric charge of the latent image on the photosensitive drum 27 is neutralized while the electric charge of the toner remains. The potential of the toner image is detected by the potential sensor 83. As a result, a total charging amount of the toner image can be determined.

In S540, based on the density of the toner image detected in S520 and the surface potential of the toner image detected in S530, the Q/M is calculated. That is, the total charging amount of the toner image is divided by the adhesive amount of the toner. The Q/M detection process is then terminated.

As above, the Q/M can be calculated from a configuration explained by way of FIGS. 14 to 16. Accordingly, the laser printer of the present embodiment is capable of printing an image having the proper density by adjusting the developing bias in the same manner as the laser printer 1 of the aforementioned embodiment.

What is claimed is:

1. An image forming apparatus comprising:

a rotary driven photoreceptor;

a charging device that charges a surface of the photoreceptor;

an exposing device that exposes the photoreceptor charged by the charging device to form an electrostatic latent image; and a developing device that develops, using developer, the electrostatic latent image formed on the photoreceptor by the exposing device to form a developer image, wherein the image forming apparatus transfers the developer image on a recording material to form an image on the recording material, the image forming apparatus further comprising:

a charged amount detection device that detects a charged amount per unit mass of the developer used by the developing device, based on a current value of the electric current flowing between a part of the photoreceptor charged by the charging device but not exposed by the exposing device and the developing device, so that the charged amount per unit mass of the developer is detected in an indirect manner; and a developing bias adjustment device that adjusts a developing bias to regulate a ratio of the charged amount per unit mass detected by the charged amount detection device to an electric current which flows between the developing device and the photoreceptor at the time of developing the electrostatic latent image representing a reference image.

2. The image forming apparatus as set forth in claim 1 wherein the charged amount detection device detects the charged amount per unit mass of the developer used by the developing device, based on a current value of the electric current flowing between a part of the photoreceptor charged by the charging device but not exposed by the exposing device and the developing device.

3. The image forming apparatus as set forth in claim 2 wherein the charging device starts charging of a surface of the photoreceptor at a timing earlier than a passing timing of a head portion of an image forming area, where the electrostatic latent image is formed by the exposing device, at a time of image forming, and the charged amount detection device detects the current value of the electric current flowing between the part of the photoreceptor charged by the charging device but where no electrostatic latent image is formed by the exposing device and the developing device, during the image forming.

4. The image forming apparatus as set forth in claim 2 wherein the charging device terminates charging of the surface of the photoreceptor at a timing later than a passing timing of a tail portion of the image forming area, where the electrostatic latent image is formed by the exposing device, at the time of image forming, and the charged amount detection device detects the current value of the electric current flowing between the part of the photoreceptor charged by the charging device but where no electrostatic latent image is formed by the exposing device and the developing device, during the image forming.

5. The image forming apparatus as set forth in claim 2 further comprising:

an initializing device that performs initialization as preparation for starting the image forming at a predetermined timing, wherein the charged amount detection device detects the current value of the electric current flowing between the part of the photoreceptor charged by the charging device but not exposed by the exposing device and the developing device, during the initialization by the initializing device.

6. The image forming apparatus as set forth in claims 2 wherein;

the charged amount detection device detects the current value while the photoreceptor makes at least one revolution.

7. The image forming apparatus as set forth in claim 2 wherein;

the charged amount detection device detects a current value at a plurality of different rotating positions of the photoreceptor.

8. The image forming apparatus as set forth in claim 7 wherein;

the charged amount detection device detects the current value equal to an average of the current values from the plurality of different rotating positions of the photoreceptor.

9. The image forming apparatus as set forth in claim 1 wherein the charged amount detection device comprises:

a specific pattern forming unit that forms a developer image representing a specific pattern;

an adhered developer amount detecting unit that detects a developer amount adhered to the developer image formed by the specific pattern forming unit; and a gross charged amount detection unit that detects a gross charged amount of the developer image formed by the specific pattern forming unit, the charged amount detection device detecting the charged amount per unit mass of the developer, based on the gross charged amount of the developer image detected by the gross charged amount detection unit and the adhered developer amount detected by the adhered developer amount detecting unit.

10. The image forming apparatus as set forth in claim 1 wherein the developer is a polymerized toner.

11. An image forming apparatus comprising:

a rotary driven photoreceptor;

a charging device that charges a surface of the photoreceptor;

an exposing device that exposes the photoreceptor charged by the charging device to form an electrostatic latent image; and a developing device that develops, using developer, the electrostatic latent image formed on the photoreceptor by the exposing device to form a developer image, wherein the image forming apparatus transfers the developer image on a recording material to form an image on the recording material, the image forming apparatus further comprising:

a charged amount detection device that detects a charged amount per unit mass of the developer used by the developing device, based on a current value of the electric current flowing between a part of the photoreceptor charged by the charging device but not exposed by the exposing device and the developing device, so that the charged amount per unit mass of the developer is detected in an indirect manner; and a developing bias adjustment device that adjusts a developing bias, based on the charged amount per unit mass detected by the charged amount detection device.

12. The image forming apparatus as set forth in claim 11 wherein the charging device starts charging of a surface of the photoreceptor at a timing earlier than a passing timing of a head portion of an image forming area, where the electrostatic latent image is formed by the exposing device, at a time of image forming, and the charged amount detection device detects the current value of the electric current flowing between the part of the photoreceptor charged by the charging device but where no electrostatic latent image is formed by the exposing device and the developing device, during the image forming.

13. The image forming apparatus as set forth in claim 11 wherein the charging device terminates charging of the surface of the photoreceptor at a timing slower than a passing timing of a tail portion of the image forming area, where the electrostatic latent image is formed by the exposing device, at the time of image forming, and the charged amount detection device detects the current value of the electric current flowing between the part of the photoreceptor charged by the charging device but where no electrostatic latent image is formed by the exposing device and the developing device, during the image forming.

14. The image forming apparatus as set forth in claim 11 further comprising:

an initializing device that performs initialization as preparation for starting the image forming at a predetermined timing, wherein the charged amount detection device detects the current value of the electric current flowing between the part of the photoreceptor charged by the charging device but not exposed by the exposing device and the developing device, during the initialization by the initializing device.

15. The image forming apparatus as set forth in claim 11 wherein;

the charged amount detection device detects the current value while the photoreceptor makes at least one revolution.

16. The image forming apparatus as set forth in claim 11 wherein;

the charged amount detection device detects a current value at a plurality of different rotating positions of the photoreceptor.

17. The image forming apparatus as set forth in claim 16 wherein;

the charged amount detection device detects the current value equal to an average of the current values from the plurality of different rotating positions of the photoreceptor.

18. The image forming apparatus as set forth in claim 11 wherein the developer is a polymerized toner.

* * * * *